US012305135B2

(12) United States Patent
Braly

(10) Patent No.: US 12,305,135 B2
(45) Date of Patent: May 20, 2025

(54) HIGH OCTANE UNLEADED AVIATION GASOLINE

(71) Applicant: GENERAL AVIATION MODIFICATIONS, INC., Ada, OK (US)

(72) Inventor: George W Braly, Ada, OK (US)

(73) Assignee: GENERAL AVIATION MODIFICATIONS, INC., Ada, OK (US)

( * ) Notice: Subject to any disclaimer, the term of this patent is extended or adjusted under 35 U.S.C. 154(b) by 0 days.

(21) Appl. No.: 16/736,253

(22) Filed: Jan. 7, 2020

(65) Prior Publication Data

US 2020/0277535 A1 Sep. 3, 2020

Related U.S. Application Data

(60) Division of application No. 14/153,950, filed on Jan. 13, 2014, now Pat. No. 10,550,347, which is a continuation-in-part of application No. 13/841,560, filed on Mar. 15, 2013, now Pat. No. 10,260,016, which is a continuation-in-part of application No. 12/958,390, filed on Dec. 1, 2010, now Pat. No. 8,628,594.

(60) Provisional application No. 61/319,255, filed on Mar. 30, 2010, provisional application No. 61/316,158, filed on Mar. 22, 2010, provisional application No. 61/265,606, filed on Dec. 1, 2009.

(51) Int. Cl.

| | |
|---|---|
| ***C10L 1/223*** | (2006.01) |
| ***C10L 1/06*** | (2006.01) |
| ***C10L 1/14*** | (2006.01) |
| ***C10L 10/10*** | (2006.01) |
| *C10L 1/182* | (2006.01) |

(52) U.S. Cl.

CPC ..... *C10L 1/223* (2013.01); *C10L 1/06* (2013.01); *C10L 1/14* (2013.01); *C10L 10/10* (2013.01); *C10G 2300/304* (2013.01); *C10G 2300/305* (2013.01); *C10G 2400/02* (2013.01); *C10L 1/1824* (2013.01); *C10L 2270/023* (2013.01); *C10L 2270/04* (2013.01)

(58) Field of Classification Search

CPC ..... C10L 1/223; C10L 10/10; C10L 2270/04; C10L 2200/0423; C10L 2270/023

See application file for complete search history.

(56) References Cited

U.S. PATENT DOCUMENTS

| | | | |
|---|---|---|---|
| 1,495,501 | A | 5/1924 | Taber |
| 1,571,862 | A | 2/1926 | Midgley, Jr. |
| 1,592,953 | A | 7/1926 | Midgley, Jr. |
| 1,605,663 | A | 11/1926 | Kettering et al. |
| 1,606,431 | A | 11/1926 | Hamby |
| 1,713,589 | A | 5/1929 | Bereslavsky |
| 1,741,032 | A | 12/1929 | Minter |
| 1,844,362 | A | 2/1932 | Hrig |
| 2,394,180 | A | 2/1946 | Imm |
| 2,398,197 | A | 4/1946 | Stanly |
| 2,409,156 | A | 10/1946 | Schulze et al. |
| 2,410,846 | A | 11/1946 | Walters |
| 2,413,262 | A | 12/1946 | Stirton |
| 2,476,315 | A | 7/1949 | Morrison |
| 2,560,602 | A | 7/1951 | Schulze |
| 2,637,635 | A | 5/1953 | McLaughlin |
| 2,917,561 | A | 12/1959 | Eby |
| 3,069,470 | A | 12/1962 | Fleck |
| 3,212,867 | A | 10/1965 | Ockerbloom |
| 3,267,165 | A | 8/1966 | Kimble |
| 4,010,358 | A | 3/1977 | Morris |
| 4,266,947 | A | 5/1981 | Hartle et al. |
| 4,294,587 | A | 10/1981 | Burns |
| 4,331,024 | A | 5/1982 | Childs et al. |
| 4,408,585 | A | 10/1983 | Stuckas |

(Continued)

FOREIGN PATENT DOCUMENTS

| | | |
|---|---|---|
| AU | 2006351908 B2 | 3/2011 |
| CA | 2672211 | 6/2008 |

(Continued)

OTHER PUBLICATIONS

Standard Specifications for Aviation Gasolines. ASTM International, 2011 (Year: 2011).*

Davidson, Hanson, Interpreting Shock Tube Ignition Data, Paper 03F-61, Mechanical Engineering Department, WSSCI Fall 2003 Meeting, Oct. 20-21, 2003, University of California (24 pages).

Cummings, H.K., Detonation Rating of Aviation Fuels, 1st World Petroleum Congress, Jul. 18-24, 1933, London, UK, (13 pages).

(Continued)

*Primary Examiner* — Ellen M McAvoy
*Assistant Examiner* — Ming Cheung Po
(74) *Attorney, Agent, or Firm* — R. Reams Goodloe, Jr.

(57) ABSTRACT

Concentrate for the manufacture of unleaded aviation gasoline. High quality aviation alkylate, or similar base fuel is blended with selected aromatic solvents, including alkyl benzenes effective to improve the functional engine performance to avoid harmful detonation in aircraft piston engines. Monoalkylated benzenes such as toluene and ethylbenzene are utilized in combination with dialkylated benzenes, such as xylenes. Aromatic amines, for example p-toluidine and m-toluidine, may be added to increase MON. Alcohols such as ethanol and/or methanol may be added in effective amounts to produce unleaded AVGAS which meets a required freeze point. Amounts of toluene to p-toluidine, and/or of the amount of p-toluidine to m-toluidine may be in a controlled ratio in amounts effective to produce unleaded AVGAS which meets a required freeze point. Isopentane and/or butane may be included to provide a required vapor pressure profile.

31 Claims, No Drawings

(56) References Cited

U.S. PATENT DOCUMENTS

| | | | | |
|---|---|---|---|---|
| 4,452,207 | A | 6/1984 | Moore, Jr. | |
| 4,480,129 | A | 10/1984 | Priegnitz et al. | |
| 4,695,292 | A | 9/1987 | Osborg | |
| 4,897,087 | A | 1/1990 | Blain et al. | |
| 5,087,781 | A | 2/1992 | Schutz et al. | |
| 5,125,235 | A | 6/1992 | Yanagihara et al. | |
| 5,284,984 | A | 2/1994 | Dessau et al. | |
| H1305 | H | 5/1994 | Townsend et al. | |
| 5,385,588 | A | 1/1995 | Brennan et al. | |
| 5,470,358 | A * | 11/1995 | Gaughan | C10L 1/223 44/426 |
| 5,653,866 | A | 8/1997 | Jessup et al. | |
| 5,851,241 | A | 12/1998 | Studzinski et al. | |
| 5,891,202 | A | 4/1999 | Barratt et al. | |
| 5,925,152 | A | 7/1999 | Barratt et al. | |
| 5,941,222 | A | 8/1999 | Braly | |
| 5,948,126 | A | 9/1999 | Barratt et al. | |
| 5,962,775 | A | 10/1999 | Liiva et al. | |
| 5,978,728 | A | 11/1999 | Fontana et al. | |
| 6,187,064 | B1 | 2/2001 | Henderson | |
| 6,238,446 | B1 | 5/2001 | Henderson | |
| 6,258,134 | B1 | 7/2001 | Studzinski | |
| 6,297,417 | B1 | 10/2001 | Samson et al. | |
| 6,411,886 | B1 | 6/2002 | Morra et al. | |
| 6,451,075 | B1 | 9/2002 | Schoppe et al. | |
| 6,565,617 | B2 | 5/2003 | Kalghatgi | |
| 6,679,302 | B1 | 1/2004 | Mattingly et al. | |
| 6,767,372 | B2 | 7/2004 | Barnes et al. | |
| 6,858,048 | B1 | 2/2005 | Jimeson et al. | |
| 7,039,518 | B2 | 5/2006 | Ingram et al. | |
| 7,416,568 | B2 | 8/2008 | Clark | |
| 7,462,207 | B2 | 12/2008 | Clark | |
| 7,553,404 | B2 | 6/2009 | Clark et al. | |
| 7,740,668 | B2 | 6/2010 | Gaughan | |
| 7,833,295 | B2 | 11/2010 | Clark | |
| 7,862,629 | B2 | 1/2011 | Gaughan et al. | |
| 7,897,034 | B2 | 3/2011 | De Oliveira et al. | |
| 8,049,048 | B2 | 11/2011 | Rusek et al. | |
| 8,232,437 | B2 | 7/2012 | Clark et al. | |
| 8,536,389 | B2 | 9/2013 | Clark et al. | |
| 8,628,594 | B1 | 1/2014 | Braly | |
| 8,715,373 | B2 | 5/2014 | Aradi et al. | |
| 8,734,540 | B2 | 5/2014 | Aradi et al. | |
| 8,781,757 | B2 | 7/2014 | Farquharson et al. | |
| 9,120,991 | B2 | 9/2015 | Shea et al. | |
| 10,260,016 | B2 | 4/2019 | Braly | |
| 10,364,399 | B2 | 7/2019 | Braly | |
| 10,377,959 | B2 | 8/2019 | Braly | |
| 2002/0005008 | A1 | 1/2002 | Studzinski et al. | |
| 2002/0045785 | A1 | 4/2002 | Bazzani et al. | |
| 2002/0055663 | A1 | 5/2002 | Barnes et al. | |
| 2002/0166283 | A1 | 11/2002 | Kalghatgi | |
| 2003/0000131 | A1 | 1/2003 | Henry et al. | |
| 2003/0040650 | A1 | 2/2003 | Butler et al. | |
| 2003/0183554 | A1 | 10/2003 | Bazzani et al. | |
| 2004/0124122 | A1 | 7/2004 | Clark | |
| 2005/0044778 | A1 | 3/2005 | Orr | |
| 2005/0144834 | A1 | 7/2005 | Jimeson et al. | |
| 2005/0229480 | A1 | 10/2005 | Gaughan et al. | |
| 2006/0052650 | A1 | 3/2006 | Thebault et al. | |
| 2006/0086040 | A1 * | 4/2006 | De Oliveira | C10L 1/06 44/385 |
| 2006/0123696 | A1 | 6/2006 | Gaughan et al. | |
| 2006/0225340 | A1 | 10/2006 | Gaughan et al. | |
| 2006/0288635 | A1 | 12/2006 | Seyfried | |
| 2007/0033859 | A1 | 2/2007 | Ketley et al. | |
| 2007/0215519 | A1 | 9/2007 | Dierickx et al. | |
| 2008/0134571 | A1 * | 6/2008 | Landschof | C10L 1/023 44/424 |
| 2008/0168706 | A1 | 7/2008 | Rusek et al. | |
| 2008/0172931 | A1 | 7/2008 | Bazzani et al. | |
| 2008/0178519 | A1 | 7/2008 | Bazzani et al. | |
| 2008/0244961 | A1 | 10/2008 | Rusek et al. | |
| 2008/0244963 | A1 | 10/2008 | Demoment et al. | |
| 2008/0289250 | A1 | 11/2008 | Bazzani et al. | |
| 2008/0295388 | A1 | 12/2008 | Bazzani et al. | |
| 2009/0013589 | A1 | 1/2009 | Aradi et al. | |
| 2009/0229172 | A1 | 9/2009 | Brady et al. | |
| 2009/0229173 | A1 | 9/2009 | Gosling | |
| 2010/0018112 | A1 | 1/2010 | Russo et al. | |
| 2010/0263262 | A1 | 10/2010 | Gaughan | |
| 2012/0029251 | A1 | 2/2012 | Hemighaus et al. | |
| 2012/0080000 | A1 | 4/2012 | Landschof et al. | |
| 2012/0279113 | A1 | 11/2012 | Landschof et al. | |
| 2013/0111805 | A1 | 5/2013 | Mathur et al. | |
| 2014/0116367 | A1 | 5/2014 | Braly | |
| 2014/0123548 | A1 | 5/2014 | Braly | |
| 2014/0202069 | A1 | 7/2014 | Aradi et al. | |
| 2015/0113862 | A1 | 4/2015 | Shea et al. | |
| 2019/0062658 | A1 | 2/2019 | Braly | |
| 2019/0062659 | A1 | 2/2019 | Braly | |

FOREIGN PATENT DOCUMENTS

| | | | |
|---|---|---|---|
| EP | 1650289 | A1 | 4/2006 |
| EP | 1611224 | B1 | 5/2010 |
| EP | 2537913 | A1 | 12/2012 |
| WO | WO 97/44413 | | 11/1997 |
| WO | WO 98/22556 | | 5/1998 |
| WO | WO 99/49003 | | 9/1999 |
| WO | WO 02/22766 | A1 | 3/2002 |
| WO | WO 2005/100513 | A2 | 10/2005 |
| WO | WO 2006/026657 | A3 | 3/2006 |
| WO | WO 2006/060364 | A3 | 8/2006 |
| WO | WO 2007/074226 | A1 | 7/2007 |
| WO | WO 2008/013922 | A1 | 1/2008 |
| WO | WO 2008/073118 | A1 | 6/2008 |
| WO | WO 2009/152495 | A2 | 12/2009 |
| WO | WO 2009/152495 | A3 | 12/2009 |
| WO | WO 2010/004395 | A1 | 1/2010 |
| WO | WO 2011/035219 | A2 | 3/2011 |
| WO | WO 2011/035219 | A3 | 3/2011 |
| WO | WO2011/109575 | A2 | 9/2011 |
| WO | WO2011/109575 | A3 | 9/2011 |

OTHER PUBLICATIONS

Avgas Review-AFC 2007, Alisdair Clark; Clark Aviation Fuels Committee, AFC Mar. 21, 2007 (27 pages).

Executive Summary, CRC Research Results, Unleaded High Octane Aviation Gasoline, A Report to the CRC Unleaded AVGTAS Development Panel, Apr. 24, 2008 (9 pages).

Atwood, David, Full-Scale Engine Detonation, Tests of 47 Unleaded, High-Octane Blends, Sep. 2008, Final Report, DOT/FAA/AR-08/40 (287 pages).

Atwood, David, Full-Scale Engine Knock Tests of 30 Unleaded, High-Octane Blends, Sep. 2004, Final Report, DOT/FAA/AR-04-25 (314 pages).

Pye, Barton, Knock-Rating: Motor Gasoline and Aviation Gasoline, 1st World Petroleum Congress, Jul. 18-24, 1933, London, (6 pages).

Evans, Garner, The Knock-Ratings of Gasolines and Their Chemical Composition, 2$^{nd}$ World Petroleum Congress, Jun. 14-19, 1937, Paris, France, (7 pages).

Heron, Gillig, Supercharged Knock Testing, 2$^{nd}$ World Petroleum Congress, Jun. 14-19, 1937, Paris, France, (11 pages).

Hofman, Lapeyrouse, Sweeney, New Blending Agents for Aviation Gasoline of 100 Octane No., 2$^{nd}$ World Petroleum Congress, Jun. 14-19, 1937, Paris, France, (8 pages).

Grebenshchikov, Influence of Gasoline Distillation Curve on Carburetor Icing, Journal Article, UDC 665.733.033.542.488, All-Union Scientific-Research Institute for Petroleum Processing (1981) (4 pages).

Persson, Hjelmco Oil AB, Presentation—Future fuels of aviation IAOPA WA, Toronto, 2006, Sweden (33 pages).

Hjelmberg, Hjelmco Oil AB, Presentation—Future fuels of aviation, Vasteras, Jan. 23, 2007 (33 pages).

Hjelmberg, Hjelmco Oil AB, Presentation—23 years of experience with Unleaded AVGAS in Sweden, (2004) (34 pages).

Hjelmco Oil, The Unleaded Aviation Gasoline With Improved Environmental Qualities, (AVGAS 91/96 UL), Edition: V. (Oct. 17, 1997) (22 pages).

(56) References Cited

OTHER PUBLICATIONS

Atwood, David, Full-Scale Engine Detonation and Power Performance Evaluation of Swift Enterprises 702 Fuel, Jan. 2009 Final Report, DOT/FAA/AR-08/53 (181 pages).
Research Results Unleaded High Octane Aviation Gasoline, Final Report, CRC Project No. AV-7-07, Jun. 2010 (298 pages).
Chevron, Aviation Fuels Technical Review, 2006 (96 pages).
Sakrison, Article, EAA Air Venture, Standards Sough For Unleaded Aviation Fuel, Aug. 1, 2008 (7 pages).
Department of the Navy, Advance Notice of Proposed Rulemaking on Lead Emissions from Piston-Engine Aircraft Using Leaded Aviation Gasoline, 75 FR 22440, Oct. 24, 2010, Docket No. EPA HQ OAR 2007 0294 (3 pages).
Bailey, Bunker, USSAF Europe WWII 100/150 GRADEFUEL, Sep. 1944 (10 pages).
Barnett, Report 1026, NACA Investigation of Fuel Performance In Piston-Type Engines (1951) (194 pages).
Sparrow, Report No. 232, Fuels for High-Compression Engines, NACA Report (1926) (20 pages).
Evaluation of Reciprocating Aircraft Engines with Unleaded Fuels, Dec. 1999, Final Report, DOT/FAA/AR-99/70 (82 pages).
Charnes, Cooper, Mellon, Econometrica, Journal of the Econometric Society, Blending Aviation Gasolines, A Study in Programming Interdependent Activities In An Integrated Oil Company, Accessed: 17:18 (Apr. 1952) (26 pages).
Johnston, Farrell, Laminar burning velocities and Markstein lengths of aromatics at elevated temperature and pressure, Proceedings of the Combustion Institute, 30 (2005) 217-224 (8 pages).
Executive Summary, CRC Research Results, Toward Development of an Unleaded High Octane Aviation Gasoline, A Report to the CRC Unleaded AVGAS Development Group, Apr. 1, 2003 (6 pages).
CRC Unleaded AVGAS Development Group Meeting, May 1, 2006, Alexandria, Virginia (8 pages).
Speight, The Chemistry and Technology of Petroleum, $4^{th}$ Edition, CRC Press, Copyright, 2007 (p. 745) (1 page).
Atwood, David, Full-Scale Engine Endurance Test of Swift Enterprises UL 102 Fuel, Jul. 2010, Final Report, DOT/FAA/AR-10/13 (70 pages).
Swift Enterprises, Presentation, Swift Sustainable Aviation Fuels, A High Octane Alternative to 100LL, EAA Airventure, Jul. 30, 2009 (28 pages).
Simpson, Martin J., The Douglas A/B-26 Invader, Fuel, (date unknown) (16 pages).
Millner, Paul, AVGAS 2020: The Future Fuel, Jun. 2006 (7 pages).
Atwood, David, High-Octane and Mid-Octane Detonation Performance of Leaded and Unleaded Fuels in Naturally Aspirated, Piston, Spark Ignition Aircraft Engines, Mar. 2007, Report, DOT/FAA/AR-TN07/5 (48 pages).
Desrosier, Presentation, Beyond 100LL, Next Steps In Addressing Leaded Aviation Gasoline, General Aviation Manufacturers Association (GAMA), GA Avgas Coalition—2011 ACI NA Environmental Affairs Conference, Jun. 27, 2011 (28 pages).
Ziulkowski, Collective Knowledge on Aviation Gasolines, Purdeu e-Pubs, Jul. 10, 2011 (213 pages).
Rumizen, Aviation Gasoline, Status and Future Prospects, Presentation, 34th Annual FAA Forecast Conference, Apr. 1, 2009 (9 pages).
Orr, Fuel-ish Questions, Fuel-ish Answers, FAA Aviation News, Jul./Aug. 2009 (4 pages).
Waxman, Letter to Michael P. Huerta, FAA, Oct. 23, 2012 (2 pages).
Midgley, Shell, Presentation, AVGAS Octane, Is Motor Octane Number the Whole Story? AFC, Mar. 2010 (18 pages).
Winkle, Aviation Gasoline Manufacture, (1944), Production of Finished Aviation Gasolines, Chapter II cover pages (3 pages) and (pp. 182-183; 191-200).
Ells, AVGAS Alternatives, Feb. 2011, Flyingmag.com (3 pages).
FAA Aviation Safety, Special Airworthiness Information Bulletin, SAIB: NE-11- 55, Sep. 14, 2011, Subject: Grade 100VLL Aviation Gasoline, (2 pages).
Kelly, Richard L., National Advisory Committee for Aeronautics, Wartime Report, Issued Nov. 1944 as Memorandum Report E4K17, The Low-Temperature Solubility of 24 Aromatic Amines in Aviation Gasoline, Aircraft Engine Research Laboratory, Cleveland, Ohio, NACA, Washington (E-164) (13 pages).
Kelly, Richard L., National Advisory Committee for Aeronautics, Wartime Report, Issued Nov. 1945 as Memorandum Report E5K09, The Low-Temperature Solubility of 42 Aromatic Amines in Aviation Gasoline, Aircraft Engine Research Laboratory, Cleveland, Ohio, NACA, Washington (E-167) (15 pages).
Apr. 25, 2014—PCT International Search Report with Written Opinion of International Searching Authority for PCT/US2014/011330 (Transmittal + 18 pages).
Sep. 25, 2015—PCT International Preliminary Report on Patentability, for PCT/US2014/011330 (Transmittal + 15 pages).
Brown, J.E. Mechanism of Aromatic Amine Antiknock Action. Industrial and Engineering Chemistry (Oct. 1955) vol. 47, No. 10, pp. 2141-2146 (6 pages).
Espacenet, European Patent Office. Bibliographic data: XP002539089
Brown, J.E. Mechanism of Aromatic Amine Antiknock Action. Industrial and Engineering Chemistry (Oct. 1955) vol. 47, No. 10, pp. 2141-2146. (1 page).
Jul. 25, 2016—Search Report and Written Opinion (European Patent Office) EP16154197 (6 pages).
Freyermuth, George H. Apr. 1945—Super Fuel For Aircraft (5 pages).
https://www.chemicalbook.com/ProductChemicalPropertiesCB2681115 EN.htm (downloaded on Jan. 7, 2019) (2 pages).
Wikipedia—Toluidine (https://en.wikipedia.org/wiki/Toluidine) (2 pages).
Options for Reducing Lead Emissions from Piston-Engine Aircraft. A Consensus Study Report of The National Academies of Sciences-Engineering-Medicine 2021, Transportation Research Board Special Report 336. The National Academies Press, Washington, DC. (Prepublication Copy—Uncorrected Proofs) . https://doi.org/10.17226/26050. (143 pages).

* cited by examiner

HIGH OCTANE UNLEADED AVIATION GASOLINE

CROSS REFERENCE TO RELATED APPLICATIONS

This application is a divisional and claims priority under 35 USC § 121 of prior and now pending U.S. patent application Ser. No. 14/153,950, filed on Jan. 13, 2014 and entitled High Octane Unleaded Aviation Gasoline. That application was a continuation-in-part of and claimed priority from U.S. patent application Ser. No. 13/841,560 filed on Mar. 15, 2013 (now U.S. Pat. No. 10,260,016 B2 issued on Apr. 16, 2019) and entitled High Octane Unleaded Aviation Gasoline. That application was a continuation-in-part of and claimed priority from U.S. patent application Ser. No. 12/958,390, filed on Dec. 1, 2010 (now U.S. Pat. No. 8,628,594 B2 issued on Jan. 14, 2014) entitled High Octane Unleaded Aviation Fuel. That application claimed priority of prior U.S. Provisional Application Ser. No. 61/265,606 filed on Dec. 1, 2009, and of prior U.S. Provisional Application Ser. No. 61/316,158 filed on Mar. 22, 2010, and prior U.S. Provisional Application Ser. No. 61/319,255 filed on Mar. 30, 2010. The disclosures of each of the above mentioned patent applications, including specification and claims, are incorporated herein in their entirety by this reference.

STATEMENT OF GOVERNMENT INTEREST

Not Applicable.

COPYRIGHT RIGHTS IN THE DRAWING

A portion of the disclosure of this patent document contains material that is subject to copyright protection. The patent owner has no objection to the facsimile reproduction by anyone of the patent document or the patent disclosure, as it appears in the Patent and Trademark Office patent file or records, but otherwise reserves all copyright rights whatsoever

TECHNICAL FIELD

This development relates to fuels for spark ignition piston engines in general aviation aircraft, and more particularly, to unleaded aviation gasoline blends formulated to withstand extremely cold temperatures during storage and operation.

BACKGROUND

The presently existing fleet of general aviation spark ignition piston engines, as well as new engines currently being delivered, and engines which are overhauled for use as replacements on existing aircraft, typically operate using leaded fuels, such as Grade 100LL, as allowed in the United States under an exemption provided by the 1990 Federal Clean Air Act Amendments. Since that Act banned the use of leaded fuels for over-the-road vehicles in the Unites States, such general aviation aircraft engines have become an increasingly visible source of atmospheric lead emissions. Environmental regulations and threatened regulations throughout the world have thus spurred investigations into the development and evaluation of possible alternative unleaded aviation fuels.

Most of the general aviation spark ignition piston engines in use today have been certified in the United States by the Federal Aviation Administration (FAA) for use with leaded aviation gasoline blends that meet the American National Standard No. ASTM D910 entitled *Standard Specification for Aviation Gasolines*. Under that standard, for Grade 100 fuel, 1.12 grams of lead per liter are provided in the fuel blend. In the most commonly used fuel, Grade 100LL, known as a "low lead" fuel, 0.56 grams of lead per liter are provided in the fuel blend. Both of those blends provide a minimum "knock value" lean mixture octane number of 99.6 per the ASTM D-2700 Test Method. Also, both of those blends provide a minimum "knock value" rich mixture octane number of 130, per the ASTM D 909 Test Method.

Given the regulatory environment, both in the U.S. and internationally, that seeks to require the minimization or elimination of the use of lead in general aviation aircraft reciprocating piston engines, the US FAA has been instrumental in conducting tests on various heretofore proposed formulations for low lead or no lead aviation gasolines. Their reports are publicly available through the US National Technical Information Service (NTIS), Springfield, Virginia 22161. Such studies include the following reports:

(1) DOT/FAA/AR-04/25, entitled Full-Scale Engine Knock Tests of 30 Unleaded, High-Octane Blends, by David Atwood and Julian Canizales, issued by the Office of Aviation Research, Washington, D.C., in September 2004;

(2) DOT/FAA/AR-TN07/5, entitled High-Octane and Mid-Octane Detonation Performance of Leaded and Unleaded Fuels in Naturally Aspirated, Piston Spark Ignition Aircraft Engines, by David Atwood, issued by the U.S. Department of Transportation, Federal Aviation Administration, in March 2007;

(3) DOT/FAA/AR-08/40, entitled Full-Scale Engine Detonation Tests of 47 Unleaded High Octane Blends, by David Atwood, issued by the Office of Aviation Research, Washington, D.C., in September 2008; and (4) DOT/FAA/AR-08/53, entitled Full-Scale Detonation and Power Performance Evaluation of Swift Enterprises 702 Fuel, by David Atwood, issued by the Office of Aviation Research, Washington, D.C., in January 2009.

The September 2004 FAA report describes how over 200 blends of potential future aviation unleaded fuels were considered. Thirty of those blends, ranging in Motor Octane Number (MON) from 96.2 to 105.6 were sufficiently promising to be blended into batches and knock-tested (as determined by ASTM D-2700 standard) in a Lycoming IO-540-K aircraft engine at the FAA William J. Hughes Technical Center in Atlantic City, New Jersey. Components of such blends included ranges of some (or of all) of various ingredients, including super alkylate, toluene, ethyl tertiary butyl ether, meta-toluidine, ethanol, and methylcyclopentadienyl manganese tricarbonyl (MMT), which were blended into a base fuel of either aviation alkylate or motor alkylate. It is of interest that the FAA researcher reported that the performance of many of the tested blends deviated from that suggested by either their MON or by their performance number (PN).

The March 2007 FAA report compared detonation performance of mid and high octane leaded and unleaded fuels. The performance of such fuels were compared at the onset of light detonation. The fuels were tested in a naturally aspirated Lycoming IO-540-K engine and in a naturally aspirated Lycoming IO-320-B aircraft piston engine. For testing, the motor octane number (MON) of fuels was determined by tests according to the protocol of ASTM International (ASTM) specification D2700. The supercharge rich rating was determined by tests according to the protocol of the ASTM D-909 standard. In general, the testing showed that the Grade 100LL fuel (with values minimally meeting the MON and Supercharge Rating of ASTM D910) significantly outperformed the matrix of tested unleaded fuels of equivalent MON, including even those with much higher ASTM Standard D-909 supercharge rich ratings, particularly as seen when operated on full scale aircraft engines rather than the laboratory test engines used to establish the ASTM Standard D-2700 MON and the D-909 rich rating performance number (PN). The March 2007 report indicates that the supercharge rich ratings do not appear to have the same significance for the matrix of unleaded fuels that were tested as they do for leaded hydrocarbon fuels. Based on the blends tested, the report clearly suggests that development of an unleaded aviation fuel with better detonation performance would be desirable.

The September 2008 FAA report was a continuation of the research described in the September 2004 report. Based on the results of the 30 potential future aviation unleaded fuel blends earlier tested, another matrix of 47 unleaded fuel blends was developed and detonation tested in a Lycoming IO-540-K aircraft piston engine at the FAA William J. Hughes Technical Center in Atlantic City, New Jersey. Components of such blends included varying ranges of "high octane components" such as aviation alkylate, super alkylate, toluene, ethyl tertiary butyl ether (ETBE), meta-toluidine, tert-butylbenzene. The blends contained iso-pentane for volatility control. Comprehensive blend formulations, by both volume fractions and mass fractions of those fuel blends were reported in Tables 2, 3, 4, and 5 of that report. The blends with a target range of 97.6 to 106.3 MON were tested against a baseline leaded reference fuel that met all specifications of ASTM D910 for Grade 100LL fuel with minimum MON and minimum performance number (PN) per ASTM D-909. The blends were also tested against a 100LL aircraft fuel purchased at the local airport. Here, the FAA researcher reported that none of the unleaded blends of equivalent or lower MON performed as well as the Grade 100LL fuel in the detonation tests, particularly as seen when operated on full scale engines rather than the laboratory test engines used to establish the ASTM D-2700 MON and the ASTM D-909 rich rating performance number. It was also demonstrated that increased fuel flow of the unleaded blends was required above the fuel flow required for 100LL in order to achieve equivalent detonation performance. In short, the tested blends provided less detonation protection than leaded formulations of equivalent motor octane number (MON). The researcher again reported that using only motor octane number (MON) based on ASTM D-2700 (for knock rating, lean mixture) to predict full scale engine performance of unleaded fuels, is inadequate.

The January 2009 report provides results of tests on a high octane, bio-fuel (fermentation based) composition identified as Swift 702 fuel, from Swift Enterprises, Ltd., of West Lafayette, Indiana. Swift 702 fuel was separately reported by Swift Enterprises, Ltd., assignee of U.S. Patent Application Publication No. 2008/0244961 A1, published on Oct. 9, 2008, as being eighty three percent (83%) by weight of mesitylene (also known as, and hereinafter identified by the chemical name 1,3,5-trimethylbenzene), and seventeen percent (17%) by weight of iso-pentane. The FAA similarly reported that the Swift 702 fuel consisted of two pure chemical compounds. The Swift 702 fuel was reported by the FAA to have a motor octane number (MON) of 104.4, as determined by ASTM Standard D-2700. The Swift 702 fuel was detonation tested in a Lycoming IO-540-K aircraft engine used in the tests noted in the two reports above. Also, the Swift 702 fuel was tested in a turbocharged non-intercooled Lycoming TIO-540-J2BD aircraft engine. These two engines were reported by the FAA as having been previously determined as having the highest octane requirements of engines in the active general aviation fleet. The Swift 702 fuel provided slightly better detonation performance than Grade 100LL fuel that was purchased from the local airport aviation gasoline fixed base operator. However, it did not meet the 50%, 90%, and end distillation points of the then current ASTM D910 specification. And, the energy content was noted as being only ninety three point six percent (93.6%) of Grade 100LL on a mass basis. Such a reduction in energy content, in conjunction with the higher fuel density, will reduce the available payload of the aircraft for a given trip of a given range. In some cases, such a reduction will be unacceptable to the operator, and may require expensive re-certification of the aircraft. Thus, it would be desirable that any replacement aviation fuel more closely meet the presently existing ASTM minimum specifications with respect to energy content per unit mass of fuel, in order to minimize any potential loss of range or payload for an aircraft using such fuels. And, it would be desirable to provide a replacement aviation fuel that minimizes the quantity of 1,3,5-tri-methylbenzene that must be produced to provide sufficient unleaded fuel to the aviation marketplace, since such compound is not presently produced in commodity quantities for fuel blending, and may be more expensive, even in large scale production, than other possible unleaded aviation gasoline components.

In other work, U.S. Pat. No. 5,470,358, entitled Unleaded Aviation Gasoline, was issued Nov. 28, 1995 to Gaughan, and assigned to Exxon Research & Engineering. The Gaughan patent discloses an unleaded aviation fuel that combines (a) an aviation gasoline base fuel having a motor octane number (MON) in the range of 90 to 93, with (b) an amount of at least one aromatic amine as that is effective to boost the motor octane number (MON) of the base fuel to at least about 98. However, many high performance aircraft engines require better performing fuels, i.e. fuels that at least have the ability to run at all significant operating conditions in a manner substantially equivalent to that presently provided by at least a fuel that meets the minimum ASTM D910 specification for Grade 100LL, if not more. An unleaded fuel blend that only provides performance equivalent to that of a 98 MON avgas on a full scale engine will likely fail at times to meet necessary engine performance requirements. Thus, it would be desirable that a fuel provide performance that meets or exceeds the minimum ASTM D910 specifications for Grade 100LL fuel. It would be even more desirable to provide a fuel that meets or exceeds the performance in full scale aircraft engine testing of an FBO Grade 100LL fuel having a selected MON. Note that it is common for FBO Grade 100LL fuels to have a selected MON well in excess of the minimum ASTM D910 specifications for Grade 100LL fuel.

U.S. Pat. No. 6,258,134 B1, entitled High Octane Unleaded Aviation Gasolines, issued Jul. 10, 2001 to Studzinski et al., and assigned to Texaco, Inc., discloses an unleaded aviation fuel of at least 94 motor octane number (MON). In an embodiment, that disclosure provides an unleaded aviation fuel having a motor octane number (MON) of at least 94, made up of the combination of (1) an unleaded alkylate base fuel having a boiling point range that is substantially wider than the range of boiling points in aviation base fuel, and having a motor octane number (MON) of at least 91, (2) an alkyl tertiary butyl ether, and (3)

an aromatic amine. Yet, high performance aircraft engines require better performing fuels.

In Europe, Hjelmco Oil AB of Sweden has been selling unleaded avgas of various blends, including a 91/96 motor octane number (MON) unleaded blend that may be used in 91/96 and in 80/97 octane engines. See http://www.hjelmco.com. The 91/96 UL MON blend was first produced in Finland and introduced in 1991, and is now produced in Sweden. Hjelmco now reports on the above noted website that it is considering a Bio-alkylate derived avgas as a possible replacement for existing Grade 100LL avgas. However, in so far as I am aware, they do not yet offer a product that is capable of providing adequate detonation performance in 100/130 octane aviation engines, in spite of their many years of experience in blending and providing unleaded aviation fuels.

Finally, U.S. Pat. No. 6,767,372 B2, entitled Aviation Gasoline Containing Reduced Amounts of Tetraethyl Lead, issued Jul. 27, 2004 to Barnes et al, and assigned to Chevron U.S.A. Inc., discloses an unleaded aviation fuel of at least 94 motor octane number (MON). In an embodiment, that disclosure provides an unleaded aviation fuel having, measured by volume, (a) about twenty percent (20%) to about eighty percent (80%) of iso-octane, (b) about five percent (5%) to about eighteen percent (18%) of toluene, (c) about one percent (1%) to about twenty percent (20%) of $C_4$ to $C_5$ paraffins, (d) greater than zero (0) to about one (1) ml of tetraethyl lead per gallon of the aviation gasoline composition, and (e) the balance of the composition being light alkylate produced in an alkylation unit using hydrogen fluoride or $H_2SO_4$ as a catalyst. In an embodiment, that aviation gasoline is described as being substantially free of ether compounds, such as methyl tertiary butyl ether (MTBE) or ethyl tertiary butyl ether (ETBE) or the like. However, the Barnes et al patent does not describe whether or not there is any possibility within the otherwise described ingredients to completely eliminate the use of tetraethyl lead. And, although it teaches reduced lead compositions in an aviation fuel, it does not provide specific suggestions as to possible formulations using the components described therein that might tend to further minimize or eliminate the use of tetraethyl lead in order to meet or exceed performance standards for presently existing for Grade 100LL aviation fuel.

Thus, in spite of the extensive testing and evaluation by the FAA and by others of various candidate unleaded aviation fuel blends, and by others as noted in the above described patent literature, there still remains an as yet unmet need for an unleaded aviation gasoline blend that can be readily used in the existing general aviation piston engine aircraft fleet as a "functional drop in substitute" for existing ASTM D910 Grade 100LL fuel. Such an unleaded aviation gasoline, particularly a fuel blend that is essentially transparent in functionality to the aircraft, the engine, and the pilot during various flight operations as compared with existing Grade 100LL fuels, and which could be mixed in aircraft on-board fuel tanks in a random manner with existing Grade 100LL fuel formulations, would assist in the reduction or phase out of existing lead containing aviation gasolines. That is because rather than requiring a simultaneous wholesale and widespread switch in unleaded aviation gasoline availability, if a new unleaded aviation gasoline with such attributes becomes available, then existing fuel systems could accommodate and provide a new unleaded aviation gasoline as it becomes locally available from fuel suppliers. And, aircraft crews would not need to be concerned with whether previously existing 100LL fuel or a new unleaded aviation gasoline blend were available at any particular airfield. Further, it would be advantageous if a new unleaded aviation gasoline were available that could be utilized with little or no mechanical alterations or replacements of existing aircraft engines or aircraft system adjustments, and which could be used with little or no additional certification or other regulatory changes from the aircraft owner or operator standpoint. And, such an unleaded aviation gasoline would be of benefit to aircraft engine manufacturers and to aircraft manufacturing companies, as a fuel having such characteristics should enable them to avoid the need for extensive redesigns of engines and equipment, conducting testing, and engage in recertification that might be required if an unleaded aviation fuel with less desirable performance characteristics were selected for widespread use. It would also be especially advantageous if in an embodiment, such a new unleaded aviation gasoline, rather than having substantially less than existing energy content for use by the aircraft, would provide as much or more energy per unit volume of fuel tank capacity, i.e. British Thermal Units (BTU's) per gallon, as existing Grade 100LL fuels. In such a manner, it would be particularly advantageous if a new unleaded aviation gasoline could be used to take full advantage of the existing mechanical design components with respect to mass flow of air into the engine, and materials of construction utilized in the fuel system, and be capable of operating without knock or detonation at rich and lean air fuel ratio conditions, with existing compression ratios, with full rated power output, in a stable and highly efficient manner in all flight operating conditions, including high power cruise conditions with lean air-fuel mixtures.

Moreover, it would be advantageous to provide a new unleaded aviation gasoline that may be produced and distributed as a substitute for, and in the same general manner as, existing petroleum feedstock aircraft fuels, using existing refinery production systems and fuel distribution systems. It would be even more useful if such a replacement aircraft fuel were provided that meets the ASTM D910 specification for detonation margins and further, either meets the remaining ASTM D910 Table 1 requirements or which only exhibits deviations from those requirements of a nature and to an extent that are not operationally significant to the pilot, the engine, and the aircraft while completely eliminating the use of lead additives.

Further, it would be advantageous to provide formulation(s) for an unleaded aviation gasoline that takes advantage of currently available raw materials which may be advantageously blended to provide an unleaded fuel which meets applicable requirements for economical manufacture, transport, storage, and use during the usual wide range of climatic conditions encountered by piston engine powered aircraft. It would be advantageous if such formulations were developed that can be proven to handle conditions encountered during storage and use in extremely cold conditions, as might be more commonly encountered during winter in the State of Alaska or in Canada.

It would also be advantageous to accomplish such goals while providing an unleaded aviation gasoline suitable for "functional drop-in" substitution, fully fungible with existing Grade 100LL aviation gasoline, in order to minimize the extent, complexity, and cost of any recertification efforts of the high performance, high-octane fuel powered engines found in existing general aviation aircraft. As used herein, the term "functional drop-in" substitution is directed to a fuel that meets aircraft engine performance requirements from an operational standpoint, and can be used transparently, from the operational standpoint (including fueling of and holding in the fuel tank, holding and processing in the fuel systems of an aircraft during storage and during operation, and consumed by combustion during operation of the aircraft engine, and producing environmentally acceptable products of combustion). As such, a "functional drop-in" fuel as described herein may or may not meet all of the current ASTM D910 specifications requirements (or a future/then current later generation similar fuel specification), except for the absence of lead. Unofficially, in some aviation fuels industry circles, such usage—i.e. meeting performance requirements but not strictly meeting ASTM or other specifications—might otherwise be known as having the capability of a "quasi-drop-in" fuel—i.e. a fuel that meets performance requirements but does not strictly meet all of the applicable ASTM D910 specifications. In this application, the term "functional drop-in" fuel is adopted, as described. In any event, it would be very helpful to the general aviation piston engine user community to have available a fuel which could be placed in the aircraft tanks and used without regard to changes in mechanical components or aircraft performance, and which will therefore minimize or eliminate regulatory paperwork. It would be even more helpful, and quite advantageous, for a new unleaded aviation gasoline to be made available that meets such objectives, and that also can be used without alterations to the aircraft or engines and without substantive changes in existing operational manuals, other than to add to the limitations section of such operational manuals the approval of the use of a new grade or description of fuel which is approved and related instructions to the pilot for how the new unleaded aviation gasoline is to be used.

SUMMARY

Exemplary unleaded high octane unleaded aviation gasoline blends are described herein, as well as methods for manufacture of the same. In an embodiment, such fuel blends provide both (a) acceptable motor octane number (MON) and meet detonation performance requirements, while simultaneously meeting freeze point performance requirements (i.e. ability to be stored and used in extremely cold conditions). In an embodiment, such an exemplary unleaded high octane unleaded aviation gasoline utilizes at least some of the widely available, but previously thought undesirable p-toluidine, but maintains its solubility at low temperatures by use of co-solvents. In an embodiment, such co-solvents include alcohols, such as ethanol, or methanol, or a combination of alcohols. In various embodiments, such co-solvents include the use of one or more monoalkylated benzenes, such as toluene or m-toluidine. Overall, the unleaded high octane unleaded aviation gasoline blends solve the problem of economically obtaining sufficient quantities of octane enhancing aromatic amines, by using, in combination, both low temperature compatible aromatic amines (e.g., m-toluidine) with less desirable yet economically available (in higher volumes) higher melting point aromatic amines (e.g., p-toluidine).

In an embodiment, concentrate additive packages are described. In an embodiment, such concentrate additive packages may include constituents that provide both (a) acceptable motor octane number (MON) and (b) acceptable freeze point performance (i.e. ability to be stored and used in extremely cold conditions). Such concentrate additive packages would enable the manufacture of an unleaded fuel blend in a distributed fashion, at remote blend points, rather than require blending at centralized refining and major distribution plants.

In an embodiment, a novel high octane unleaded aviation gasoline blend is provided for use in aircraft piston engines. In an embodiment, an unleaded fuel blend includes (a) at least one unleaded aviation gasoline base fuel, such as a high grade aviation alkylate having a selected motor octane number (MON), and (b) an amount of a selected alkyl benzenes. In an embodiment, the type and amount of alkyl benzenes selected is an amount effective to increase the detonation performance of the unleaded aviation gasoline blend to the equivalent, or better than, the detonation performance in a full scale aircraft engine of Grade 100LL avgas which minimally meets the motor octane rating requirements set forth in ASTM Standard D910. In an embodiment, one or more dialkylbenzenes, such as meta-xylene, para-xylene, or ortho-xylene may be used. In various embodiments, the meta-xylene and para-xylene together comprise no more than about forty five percent (45%) by weight of the high octane unleaded aviation gasoline. In an embodiment, the para-xylene comprises no more than about thirteen percent (13%) by weight of the high octane unleaded aviation gasoline. In an embodiment, the ortho-xylene comprises no more than about eleven percent (11%) by weight of the high octane unleaded aviation gasoline. In various embodiments, a novel high octane unleaded aviation gasoline may contain two or more monoalkylated benzenes, and such two or more monoalkylated benzenes may include ethylbenzene and toluene. In various embodiments, for additional octane enhancement, aromatic benzenes may be included. Suitable aromatic benzenes may include a selected amount of p-toluidine and a selected amount of m-toluidine. For enhancement of cold weather service properties, including meeting freeze point requirements, a selected amount of one or more selected alcohols may be provided. In an embodiment, the selected amount of the one or more selected alcohols may comprise from more than zero percent (0%) to about four percent (4%) by weight of the high octane unleaded aviation gasoline. In various embodiments, the use of effective amounts of ethanol, and/or methanol to reach desired freeze point requirements may be utilized. For example, in an embodiment, the formulations may include an effective amount of selected alcohols wherein the freezing point of the high octane unleaded aviation gasoline is minus forty seven degrees Centigrade (−47° C.), or lower, as tested per ASTM standard D910 for Grade 100LL aviation gasoline. In another embodiment, the formulations may include an effective amount of selected alcohols wherein the freezing point of the high octane unleaded aviation gasoline is minus fifty eight degrees Centigrade (−58° C.), or lower, as tested per ASTM standard D910 for Grade 100LL aviation gasoline. In various embodiments, the high octane unleaded aviation fuel blend may include a combination of effective amounts of butane and isopentane, wherein vapor pressure in the high octane unleaded aviation gasoline is in the range between 38 kPa and 49 kPa, as measured using ASTM Standard D5191.

In various embodiments, a high quality aviation alkylate, may be utilized as a selected base fuel. In similar embodiments, similar products such as commercially available iso-octane may be utilized as a selected base fuel. In various embodiments, the base fuel may have a motor octane number of about 96, or more. In any event, the selected base fuel is blended with selected alkyl benzenes to improve the functional engine performance to avoid harmful detonation, in amounts effective to meet or exceed detonation performance requirements in aircraft spark ignition piston engines designed for use with Grade 100LL avgas. Monoalkylated benzenes such as toluene and ethylbenzene may be utilized in combination with dialkylated benzenes, such as xylenes. Aromatic amines, including p-toluidine and m-toluidine, may be added to increase MON. Alcohols such as ethanol and/or methanol may be added in effective amounts to produce a high octane unleaded aviation gasoline that meets a required freeze point for extremely cold weather operations. In various embodiments, attention to blend ratios, including the ratio of the amount of toluene to p-toluidine, and/or of the ratio of the amount of p-toluidine to m-toluidine, may provide effective amounts of the constituents to produce a high octane unleaded aviation gasoline that meets a required freeze point. Additionally, isopentane and/or butane may be included to provide a required vapor pressure profile.

Additionally, in order to increase motor octane number (MON) of a final unleaded aviation gasoline blend in a cost effective manner, and to simplify the manufacturing of novel unleaded aviation gasoline blends as described herein, in various embodiments, one or more aromatic amines may be utilized by an avgas manufacturer in a method of manufacturing unleaded avgas to increase the MON, in order to provide detonation performance in a full scale engine equivalent to that, or better, of an FBO Grade 100LL avgas of a selected MON. In various embodiments, such one or more aromatic amines may be utilized by an avgas manufacturer in a method of manufacturing avgas to increase the MON, in order to provide a "knock value", as Motor Octane Number (MON) of at least 99.6, as measured by the ASTM D2700 Test Method. In an embodiment, the amount of aromatic amines provided may be somewhere in the range from more than zero percent (0%) up to a maximum of about four point five percent (4.5%) by weight in the final aviation unleaded fuel blend. In an embodiment, the amount of aromatic amines provided may be somewhere in the range from more than zero percent (0%) up to a maximum of about six percent (6.0%) by weight in the final aviation unleaded fuel blend. In an embodiment, a combination of aromatic amines may be selected for use in a high octane unleaded fuel blend. In an embodiment, a suitable combination of aromatic amines may include m-toluidine (also known as meta-toluidine) and p-toluidine (also known as para-toluidine). In this regard although p-toluidine has known octane enhancement properties, it has generally been thought to be an undesirable candidate component for a high octane aviation gasoline, due to its high melting point of +44° C. Thus, the use of such a combination of aromatic amines, including p-toluidine, solves a significant problem which was faced when trying to develop a commercially viable high octane unleaded aviation gasoline, namely how can commercially reasonable quantities of octane enhancing constituents such as aromatic amines be obtained and utilized in an unleaded aviation gasoline in which performance and freeze point requirements are assured.

In various embodiments, the high octane unleaded aviation gasolines described herein provide a novel fuel which may be utilized as a functional drop-in substitute fuel for Grade 100LL avgas. In various embodiments, such fuels enable the use of full rated power output from existing aircraft engines, in a manner equivalent to the power output obtained when using existing FBO Grade 100LL avgas blends. Further, in various embodiments, such new unleaded aviation gasoline fuel blends enable reliable aircraft engine operation in a fuel efficient and economical manner, especially during extremely cold climatic conditions, while utilizing economically advantageous and commercially available raw materials.

DETAILED DESCRIPTION

Exemplary high octane unleaded aviation gasoline blend compositions are set forth herein. Methods for the preparation of such novel high octane unleaded aviation gasoline blends, and concentrate additive packages for use in methods for the manufacture of such novel high octane unleaded aviation gasoline blend(s) are provided. Such high octane unleaded gasolines have been developed as direct "drop-in-substitutions"—or at least for "functional drop-in substitutions"—and which provide equivalent performance in spite of minor deviations from standard ASTM specifications for aviation gasolines such as Grade 100LL. Generally, as the term is used herein, "unleaded aviation gasoline" refers to gasoline possessing the specific properties suitable for fueling aircraft powered by reciprocating spark ignition engines, where lead is not intentionally added at the point of manufacture or first shipment.

As described in my prior patent applications as noted above, as a result of testing of a novel unleaded aviation gasoline blend in a full scale aircraft engine test stand, as well as in a turbocharged aircraft in flight, I have discovered that it is possible to provide, in an embodiment, an unleaded aviation gasoline blend by mixing (1) an unleaded aviation gasoline base fuel (high grade aviation alkylate or commercial iso-octane or mixtures thereof), with (2) effective amounts of an alkylated benzenes, and particularly dialkyl benzenes such as various xylenes, to increase the detonation performance of the unleaded aviation gasoline blend when operated on a full scale aircraft engine to the equivalent, or better than, the full scale engine detonation performance of a Grade 100LL avgas which minimally meets the octane rating requirements set forth in ASTM Standard D910. In other words, in an embodiment, novel unleaded aviation gasoline blend can be provided that are equivalent to the full scale engine performance of a Grade 100LL avgas which meets the minimum MON rating requirements set forth in ASTM D910. Further, such testing has determined that an unleaded aviation gasoline blend may be formulated that provides detonation performance when operated on full scale aircraft engines to approximately the equivalent of, or better than, the full scale engine detonation performance of a FBO Grade 100LL avgas having a selected MON. Such benefits are especially noticeable when the testing proceeds using standard ASTM test procedures at detonation performance conditions of wherein detonation performance is determined at detonation intensity levels of twenty (20) BAR, determined by calculating a moving average of the detonation intensities of at least 7 but not more than 20 consecutive combustion events, using test procedures set forth in ASTM D6424 to calculate the detonation intensity of each individual combustion event.

Thus, by testing the novel unleaded aviation gasoline blends described herein at load in an actual aircraft engine in a fully instrumented test stand, it was observed that, at least to some extent, the detonation performance on the full scale aircraft engine of certain novel unleaded aviation gasoline blends exceeds the detonation performance which would be expected for such blends based on MON test results, or other existing test standards (e.g. the ASTM D 2700 motor octane test required under ASTM Standard D910). Again, such beneficial performance is especially noticeable when the detonation performance is determined at detonation intensity levels of twenty (20) BAR, determined by calculating a moving average of the detonation intensities of at least 7 but not more than 20 consecutive combustion events, using test procedures set forth in ASTM D6424 to calculate the detonation intensity of each individual combustion event.

Such beneficial synergistic effect seems to especially manifest itself as demonstrated in full scale aircraft engine detonation performance testing in the case of novel unleaded aviation fuel blends which include alkylated benzenes having methyl groups in a meta-ring position. For example, using a mixture of 1,3-dimethylbenzene (meta-xylene) and 1,4-dimethylbenzene (para-xylene), in amounts when added together amounts to slightly less than about half, by weight (e.g. up to a maximum of forty five percent (45%) by weight) of the total unleaded aviation gasoline blend in connection with other constituents as described herein may provide the necessary performance properties. However, various other alkylated benzenes, such as ethylbenzene and ortho-xylene, may compose a portion of such mixture in order to facilitate commercially economical production and meet overall fuel blend performance objectives.

However, when I investigated commercially available components that might be useful for increasing the motor octane number (MON) of a final unleaded aviation gasoline blend in a cost effective manner, I found that it appears unlikely that a sufficient supply of m-toluidine would be available, at least in the short term, to provide adequate quantities to support the widespread manufacture of a new high octane unleaded gasoline that contained appreciable amounts of m-toluidine. And, although I was aware that the octane enhancing properties of p-toluidine were well known, due to the relatively high melting point (plus forty four degrees Centigrade (+44° C.)) for p-toluidine as compared to the melting point of m-toluidine (minus thirty degrees Centigrade (−30° C.)), the use of p-toluidine has heretofore been generally considered undesirable in aviation gasolines, at least in any appreciable quantities, at least for fuel blends compatible with extremely cold storage and operating conditions which are routine for aircraft. Moreover, given that the toludine isomers are produced at present in ratios of roughly 60% o-toluidine, 36% p-toluidine, and 4% m-toluidine, it is clear that finding a way to use other octane enhancing aromatic amines, such as p-toluidine, would solve a key soppy chain barrier which, in part, may currently prevent the widespread adoption of a high octane unleaded aviation gasoline. And, although the o-toluidine isomer has a desirable minus 28 degrees Centigrade (−28° C.) melting point, its undesirable toxicity characteristics are generally believed likely to prevent its use in a desirable high octane unleaded aviation gasoline.

I have now discovered that by adopting the use of certain co-solvents, it is possible to use appreciable quantities of p-toluidine in a high octane unleaded gasoline, while maintaining freeze point protection to extremely low freezing point conditions. The use of such co-solvents also enables efficient manufacturing of a high octane unleaded aviation gasoline, as well as the development of concentrate additive packages for use in a method of distributed manufacture of a high octane unleaded aviation gasoline. In various embodiments, one or more aromatic amines, including p-toluidine, may be utilized. In various embodiments, an effective amount of such one or more aromatic amines may be utilized to increase the MON, in order to provide a "knock value", as Motor Octane Number (MON) of at least 99.6, as measured by the ASTM D2700 Test Method. In an embodiment, the amount of aromatic amines provided may be somewhere in the range from more than zero percent (0%) up to a maximum of about four point five percent (4.5%) by weight in the final high octane unleaded gasoline. In an embodiment, the amount of aromatic amines provided may be somewhere in the range from more than zero percent (0%) up to a maximum of about six percent (6.0%) by weight. In an embodiment, a combination of aromatic amines may be selected for use in a high octane unleaded fuel blend. In an embodiment, a suitable combination of aromatic amines may include m-toluidine (also known as meta-toluidine) and p-toluidine (also known as para-toluidine). The use of the combination of aromatic amines, including p-toluidine, solves a significant problem which was faced when trying to develop a commercially viable high octane unleaded aviation gasoline, namely how can commercially reasonable quantities of octane enhancing aromatic amine constituents be obtained and utilized in an unleaded aviation gasoline in which performance and freeze point requirements are assured.

In developing novel high octane unleaded gasoline compositions which satisfy both detonation performance requirements and freeze point protection requirements, I conducted a series of tests. Various embodiments for the composition of a suitable high octane unleaded aviation gasoline were evaluated. Candidate compositions from twenty of such tests are set forth in TABLE 1 (compositions from tests No. 1 through No. 10) and in TABLE 2 (compositions from tests No. 11 through No. 20).

The "Base High Aromatic Unleaded Gasoline" used as the "base fuel" in the tests did not include aromatic amines, alcohols, or toluene therein. The "base fuel" formulation used for testing included (a) a xylol mixture base in the amount of 46.6 percent by weight, (b) high grade alkylate in the amount of 38.3 percent by weight, (c) isopentane in the amount of 6.8% by weight, and (d) butane in the amount of 4.7% by weight. More specific details on xylol mixture formulation is noted below, and the reader is further referred to the xylol specification provided by ASTM. The noted aromatic amine additives that were tested, namely p-toluidine ("p-T") and m-toluidine ("m-T"), can be blended with one or more diluents or carrier fluids (as tested, toluene, and also ethanol and/or methanol), and can then be admixed with the base fuel gasoline formulation. Such a procedure may be useful in a concentrate additive package, for use in manufacture of a high octane unleaded aviation gasoline, as further noted below. The concentration of solvents such as toluene, ethanol, and the like in a concentrate additive package to be admixed with the base fuel gasoline must be taken into account in any final unleaded aviation gasoline composition, and the effective amount of additives to form the final gasoline composition adjusted accordingly.

Test No. 1 included a base fuel at 91.4%, toluene at 5.0%, p-toluidine at 2.6%, m-toluidine at 0.5%, no ethanol, and methanol at 0.5%. The ratio of toluene to p-toluidine was 1.92. The ratio of p-toluidine to m-toluidine was 5.20. The formulation was found to be cloudy (reached the freezing point where certain components froze from the solution) at −57° C.

Test No. 2 included a base fuel at 90.9%, toluene at 5.0%, p-toluidine at 2.6%, m-toluidine at 0.5%, no ethanol, and methanol at 1.0%. The ratio of toluene to p-toluidine was 1.90. The ratio of p-toluidine to m-toluidine was 5.24. The formulation was found to be cloudy (reached the freezing point where certain components froze from the solution) at −63.3° C.

Test No. 3 included a base fuel at 91.4%, toluene at 5.0%, p-toluidine at 2.6%, no m-toluidine, ethanol at 1.0%, and no methanol. The ratio of toluene to p-toluidine was 1.92. There was no m-toludine, so the ratio of p-toluidine to m-toluidine was not reported. The formulation was found to be cloudy (reached the freezing point where certain components froze from the solution) at −62.0° C.

Test No. 4 included a base fuel at 90.0%, toluene at 4.9%, p-toluidine at 3.6%, m-toluidine at 0.5%, ethanol at 1%, and no methanol. The ratio of toluene to p-toluidine was 1.36. The ratio of p-toluidine to m-toluidine was 7.35. The formulation was found to be cloudy (reached the freezing point where certain components froze from the solution) at −56.0° C.

Test No. 5 included a base fuel at 89.4%, toluene at 4.9%, p-toluidine at 3.7%, m-toluidine at 0.5%, ethanol at 1.5%, and no methanol. The ratio of toluene to p-toluidine was 1.32. The ratio of p-toluidine to m-toluidine was 7.55. The formulation was found to be NOT cloudy at −66.0° C.

Test No. 6 included a base fuel at 90.0%, toluene at 4.9%, p-toluidine at 3.5%, m-toluidine at 0.5%, ethanol at 1.5%, and no methanol. The ratio of toluene to p-toluidine was 1.40. The ratio of p-toluidine to m-toluidine was 7.14. The formulation was found to be cloudy (reached the freezing point where certain components froze from the solution) at −59.8° C.

Test No. 7 included a base fuel at 92.8%, toluene at 5.1%, p-toluidine at 1.1%, no m-toluidine, ethanol at 1.0%, and no methanol. The ratio of toluene to p-toluidine was 4.64. The ratio of p-toluidine to m-toluidine was not reported, since there was no m-toluidine. The formulation was found to be cloudy (reached the freezing point where certain components froze from the solution) at −59.0° C.

Test No. 8 included a base fuel at 92.3%, toluene at 5.1%, p-toluidine at 1.1%, no m-toluidine, ethanol at 1.5%, and no methanol. The ratio of toluene to p-toluidine was 4.64. The ratio of p-toluidine to m-toluidine was not reported, since there was no m-toluidine. The formulation was found to be NOT cloudy at −67.0° C.

Test No. 9 included a base fuel at 91.4%, toluene at 5.0%, p-toluidine at 2.1%, no m-toluidine, ethanol at 1.5%, and no methanol. The ratio of toluene to p-toluidine was 2.38. The ratio of p-toluidine to m-toluidine was not reported, since there was no m-toluidine. The formulation was found to be NOT cloudy at −65.0° C.

Test No. 10 included a base fuel at 90.5%, toluene at 4.9%, p-toluidine at 3.1%, no m-toluidine, ethanol at 1.5%, and no methanol. The ratio of toluene to p-toluidine was 1.58. The ratio of p-toluidine to m-toluidine was not reported, since there was no m-toluidine. The formulation was found to be cloudy (reached the freezing point where certain components froze from the solution) at −56.0° C.

Test No. 11 included a base fuel at 90.0%, toluene at 4.9%, p-toluidine at 3.1%, no m-toluidine, ethanol at 2.0%, and no methanol. The ratio of toluene to p-toluidine was 1.58. The ratio of p-toluidine to m-toluidine was not reported, since there was no m-toluidine. The formulation was found to be NOT cloudy at −64.5° C.

Test No. 12 included a base fuel at 89.3%, toluene at 4.80%, p-toluidine at 4.0%, no m-toluidine, ethanol at 1.9%, and no methanol. The ratio of toluene to p-toluidine was 1.20. The ratio of p-toluidine to m-toluidine was no reported since there was no m-toluidine. The formulation was found to be cloudy (reached the freezing point where certain components froze from the solution) at −46.0° C.

Test No. 13 included a base fuel at 88.0%, toluene at 4.8%, p-toluidine at 4.0%, m-toluidine at 0.5%, ethanol at 1.9%, and no methanol. The ratio of toluene to p-toluidine was 1.20. The ratio of p-toluidine to m-toluidine was 8.00. The formulation was found to be NOT cloudy at −64.0° C.

Test No. 14 included a base fuel at 90.9%, toluene at 4.0%, p-toluidine at 3.1%, m-toluidine at 0.5%, ethanol at 1.5%, and no methanol. The ratio of toluene to p-toluidine was 1.29. The ratio of p-toluidine to m-toluidine was 6.33. The formulation was found to be cloudy at −60.0° C.

Test No. 15 included a base fuel at 89.6%, toluene at 4.9%, p-toluidine at 3.0%, m-toluidine at 0.5%, ethanol at 2.0%, and no methanol. The ratio of toluene to p-toluidine was 1.63. The ratio of p-toluidine to m-toluidine was 6.12. The formulation was found to be cloudy at −60.0° C.

Test No. 16 included a base fuel at 91.9%, toluene at 5.0%, p-toluidine at 2.6%, m-toluidine at 0.5%, no ethanol, and no methanol. The ratio of toluene to p-toluidine was 1.92. The ratio of p-toluidine to m-toluidine was 5.10. The formulation was found to be cloudy at −54.0° C.

Test No. 17 included a base fuel at 91.3%, toluene at 5.0%, p-toluidine at 2.6%, m-toluidine at 0.5%, no ethanol, and methanol at 0.5%. The ratio of toluene to p-toluidine was 1.91. The ratio of p-toluidine to m-toluidine was 5.28. The formulation was found to be cloudy at −54.0° C.

Test No. 18 included a base fuel at 90.4%, toluene at 5.0%, p-toluidine at 2.6%, m-toluidine at 0.5%, ethanol at 1.5%, and no methanol. The ratio of toluene to p-toluidine was 1.90. The ratio of p-toluidine to m-toluidine was 5.24. The formulation was found to be cloudy at −61.0° C.

Test No. 19 included a base fuel at 90.0%, toluene at 4.9%, p-toluidine at 2.6%, m-toluidine at 0.5%, ethanol at 2.0%, and no methanol. The ratio of toluene to p-toluidine was 1.88. The ratio of p-toluidine to m-toluidine was 5.22. The formulation was found to be cloudy at −63.0° C.

TABLE 1

| Test # | % Base High Aromatic UL Gasoline (G100UL) w/o aromatic amines, alcohol, or toluene | % Toluene | % pT | % mT | % Ethanol | % Methanol | CLEAR AT | Fz Point CLOUDY AT | ratio Toluene/pT | ratio pT/mT |
|---|---|---|---|---|---|---|---|---|---|---|
| 1 | 91.4 | 5.0 | 2.6 | 0.5 | 0.0 | 0.5 | NR | −57 C. | 1.92 | 5.20 |
| 2 | 90.9 | 5.0 | 2.6 | 0.5 | 0.0 | 1.0 | −63.0 C. | −63.3 C. | 1.90 | 5.24 |
| 3 | 91.4 | 5.0 | 2.6 | 0.0 | 1.0 | 0.0 | −60.0 C. | −62.0 C. | 1.92 | — |
| 4 | 90.0 | 4.9 | 3.6 | 0.5 | 1.0 | 0.0 | −55.0 C. | −56.0 C. | 1.36 | 7.35 |
| 5 | 89.4 | 4.9 | 3.7 | 0.5 | 1.5 | 0.0 | −66.0 C. | <−66.0 C. | 1.32 | 7.55 |
| 6 | 90.0 | 4.9 | 3.5 | 0.5 | 1.5 | 0.0 | −58.0 C. | −59.8 C. | 1.40 | 7.14 |
| 7 | 92.8 | 5.1 | 1.1 | 0.0 | 1.0 | 0.0 | −58.0 C. | −59.0 C. | 4.64 | — |
| 8 | 92.3 | 5.1 | 1.1 | 0.0 | 1.5 | 0.0 | −67.0 C. | <−67.0 C. | 4.64 | — |

TABLE 1-continued

| Test # | % Base High Aromatic UL Gasoline (G100UL) w/o aromatic amines, alcohol, or toluene | % Toluene | % pT | % mT | % Ethanol | % Methanol | CLEAR AT | Fz Point CLOUDY AT | ratio Toluene/pT | ratio pT/mT |
|---|---|---|---|---|---|---|---|---|---|---|
| 9 | 91.4 | 5.0 | 2.1 | 0.0 | 1.5 | 0.0 | −65.0 C. | <−65.0 C. | 2.38 | — |
| 10 | 90.5 | 4.9 | 3.1 | 0.0 | 1.5 | 0.0 | NR | −56.0 C. | 1.58 | — |

TABLE 2

| Test # | % Base High Aromatic UL Gasoline (G100UL) w/o aromatic amines, alcohol, or toluene w/o mT or pT | % Toluene | % pT | % mT | % Ethanol | % Methanol | CLEAR AT | Fz Point CLOUDY AT | ratio Toluene/pT | ratio pT/mT |
|---|---|---|---|---|---|---|---|---|---|---|
| 11 | 90.0 | 4.9 | 3.1 | 0.0 | 2.0 | 0.0 | −64.5 C. | NR | 1.58 | — |
| 12 | 89.3 | 4.8 | 4.0 | 0.0 | 1.9 | 0.0 | NR. | −46.0 C. | 1.20 | — |
| 13 | 88.8 | 4.8 | 4.0 | 0.5 | 1.9 | 0.0 | −64.0 C. | NR | 1.20 | 8.00 |
| 14 | 90.9 | 4.0 | 3.1 | 0.5 | 1.5 | 0.0 | −58.0 C. | −60.0 C. | 1.29 | 6.33 |
| 15 | 89.8 | 4.9 | 3.0 | 0.5 | 2.0 | 0.0 | −59.0 C. | −60.0 C. | 1.63 | 6.12 |
| 16 | 91.9 | 5.0 | 2.6 | 0.5 | 0.0 | 0.0 | NR | −54.0 C. | 1.92 | 5.10 |
| 17 | 91.3 | 5.0 | 2.6 | 0.5 | 0.0 | 0.5 | NR | −54.0 C. | 1.91 | 5.28 |
| 18 | 90.4 | 5.0 | 2.6 | 0.5 | 1.5 | 0.0 | −58.0 C. | −61.0 C. | 1.90 | 5.24 |
| 19 | 90.0 | 4.9 | 2.6 | 0.5 | 2.0 | 0.0 | −61.0 C. | −63.0 C. | 1.88 | 5.22 |
| 20 | 90.9 | 5.0 | 2.6 | 0.5 | 0.0 | 1.0 | −63.0 C. | −64.0 C. | 1.90 | 5.26 |

Test No. 20 included a base fuel at 90.9%, toluene at 5.0%, p-toluidine at 2.6%, m-toluidine at 0.5%, no ethanol, and methanol at 1.0%. The ratio of toluene to p-toluidine was 1.90. The ratio of p-toluidine to m-toluidine was 5.26. The formulation was found to be cloudy at −64.0° C.

Thus, I have discovered that it is entirely possible to formulate a high octane unleaded aviation gasoline which is capable of meeting very low freeze point conditions, while utilizing as a component the previously thought undesirable component of p-toluidine. It is clear based on the above described testing that in various embodiments, a freezing point objective of −47.0° C. may be achieved. It is also clear based on the above described testing that in various embodiments, a freezing point objective of −58.0° C. may be achieved.

In various embodiments, a high octane unleaded aviation gasoline may be provided by using a selected base unleaded fuel, such as a high grade aviation alkylate having a selected motor octane number (MON). More generally, such base fuels used in aviation gasolines consist of blends of refined hydrocarbons, derived from crude petroleum, natural gasoline, or blends, thereof, with synthetic hydrocarbons or aromatic hydrocarbons, or both. In an embodiment, a high grade aviation alkylate would be one composed primarily of isooctane (2,2,4-trimethylpentane) and the isomers thereof, and other components that results through the typical refinery alkylation units. Such high grade aviation alkylates may more generally be defined as including those base fuels which have a motor octane number (MON) of at least 96. In other embodiments, a high grade aviation alkylate may have a motor octane number (MON) of 97 or better. In other embodiments, a high grade aviation alkylate may have a motor octane number (MON) of 98 or better.

In various embodiments effective amounts of one or more dialkylbenzenes are mixed with the high grade aviation alkylate, or other similar base fuel. The one or more dialkylbenzenes may comprise meta-xylene, para-xylene, or ortho-xylene. In various embodiments, the meta-xylene and the para-xylene together comprise no more than about forty five percent (45%) by weight of the finished high octane unleaded aviation gasoline. In an embodiment, the para-xylene comprises no more than about thirteen percent (13%) by weight of the finished high octane unleaded aviation gasoline. In an embodiment, the ortho-xylene comprises no more than eleven percent (11%) by weight of the finished high octane unleaded aviation gasoline.

In various embodiments, two or more monoalkylated benzenes are mixed with the high grade aviation alkylate, or other similar base fuel. In an embodiment, the two or more monoalkylated benzenes include ethylbenzene and toluene. In an embodiment, the toluene may be provided at about ten percent (10%) or less of the finished high grade unleaded aviation gasoline. In an embodiment, the toluene may be provided at about six percent (6%) or less of the finished high grade unleaded aviation gasoline.

In various embodiments, aromatic amines are mixed with the high grade aviation alkylate, or other similar base fuel. In various embodiments, a selected amount of p-toluidine is provided. In various embodiments, a selected amount of p-toluidine may be provided in a range from more than zero percent (0%) to not more than six percent (6%) by weight of a finished high octane unleaded aviation gasoline. In various embodiments, the amount of toluene provided is in an amount that is equal to or greater than the amount of p-toluidine, by weight, in the finished high octane unleaded aviation gasoline. In various embodiments, the amount of toluene provided may be an amount that is from about 1:1 to about 2:1, by weight, compared to the amount of p-toluidine. In an embodiment, the amount of toluene provided may be an effective amount whereby a finished high octane unleaded aviation gasoline meets a freezing point requirement. In various embodiments, the amount of p-toluidine provided may be about four percent (4%) plus or minus one point five percent (1.5%) by weight of a finished high octane unleaded aviation gasoline. In such instance, the amount of toluene may comprise an amount that is equal to or greater than the amount of the p-toluidine, by weight; In various embodiments, the amount of p-toluidine provided may be about three point five percent (3.5%) plus or minus one point five percent (1.5%) by weight of a finished high octane unleaded aviation gasoline.

In various embodiments, a selected amount of m-toluidine may be provided. In some of such embodiments, the selected amount of m-toluidine may be from more than zero percent (0%) to not more than six percent (6%) by weight of said high octane unleaded aviation gasoline. In an embodiment, the amount of m-toluidine may be about one and one-half percent (1.5%) plus or minus about one point two-five percent (1.25%) by weight of a finished high octane unleaded aviation gasoline. In various embodiments, the selected amount of p-toluidine and the selected amount of m-toluidine is in a ratio, by weight, of between 2:1 and 8:1, respectively. In other embodiments, the selected amount of p-toluidine and said m-toluidine may be present in a ratio by weight of between 2.5:1 and 8:1, respectively. In various embodiments, an effective amount of m-toluidine may be provided to enable the high octane unleaded aviation gasoline to meet said freezing point.

In various embodiments, additional constituents are added to the high grade aviation alkylate, or other similar base fuel in amounts effective to achieve the extremely low freeze point requirements which may be established for a particular fuel. In an embodiment, such additional constituents may include a selected amount of one or more selected alcohols. In various embodiments, the selected amount of the one or more selected alcohols may comprise from more than zero percent (0%) to about six percent (6%) of the finished high octane unleaded aviation gasoline. In various embodiments, the selected one or more selected alcohols may include ethanol, and in such event, the ethanol may be present from more than zero percent (0%) to not more than six percent (6%) by weight of a finished high octane unleaded aviation gasoline. In various embodiments, the selected amount of the one or more selected alcohols may comprise from more than zero percent (0%) to about four percent (4%) of the finished high octane unleaded aviation gasoline. In various embodiments, the one or more selected alcohols may include methanol. In such a case, the selected amount of methanol may be from more than zero percent (0%) to not more than two percent (2%) by weight of a finished high octane unleaded aviation gasoline. In an embodiment, the selected alcohol may consist essentially of methanol, and in such case, the selected amount of methanol may be from zero percent (0%) to not more than two percent (2%) by weight of said high octane unleaded aviation gasoline. In an embodiment, the selected alcohol may be isopropyl alcohol. In an embodiment, an effective amount of a selected alcohol may be provided wherein the freezing point of a finished high octane unleaded aviation gasoline is minus forty seven degrees Centigrade (−47° C.), or lower, as tested per ASTM standard D910 for Grade 100LL aviation gasoline. In an embodiment, an effective amount may be provided wherein the freezing point of a finished high octane unleaded aviation gasoline is minus fifty eight degrees Centigrade (−58° C.), or lower, as tested per ASTM standard D910 for Grade 100LL aviation gasoline.

In various embodiments, the amount of ethanol provided may be an amount that is from about 1:4 to about 2:3, by weight, compared to the amount of p-toluidine. In various embodiments, the amount of methanol provided may be an amount that is from about 1:4 to about 2:3, by weight, compared to the amount of p-toluidine. In an embodiment, the selected alcohols may include ethanol and methanol, and wherein the total combined amount of ethanol and said methanol is from more than zero percent (0%) to not more than four percent (4%) by weight of a finished high octane unleaded aviation gasoline. In an embodiment, the one or more selected alcohols may consist essentially of methanol and ethanol, and in such instance, the amounts of methanol and said ethanol (taken together) may be from about 1:4 to about 2:3, by weight, compared to the amount of p-toluidine provided. In various embodiments, the amounts of the one or more selected alcohols may comprise an amount effective, in combination, so that the finished high octane unleaded aviation gasoline meets said freezing point.

Finally, as is generally known in the art of manufacture of aviation gasolines, butane and/or isopentane may be added to a high grade aviation alkylate, or other similar base fuel in amounts effective to achieve a desired vapor pressure curve. In an embodiment, a combination of effective amounts of butane and isopentane may be added wherein the vapor pressure in the finished high octane unleaded aviation gasoline is in the range between 38 kPa and 49 kPa, as measured using ASTM Standard D5191.

In an embodiment, a concentrate additive package may be provided for the manufacture of high octane unleaded aviation gasoline. In an embodiment, the concentrate may include (a) one or more aromatic solvents, said aromatic solvents, not more than about fifty percent (50%) by weight of the concentrate. In an embodiment, at least one of the one or more aromatic solvents includes toluene. In an embodiment, the amount of toluene may be at least about forty percent (40%) by weight of the concentrate.

Further, one or more aromatic amines are included in the additive package. The one or more aromatic amines may be present, collectively, at not more than about fifty five percent (55%) by weight. In an embodiment, the one or more aromatic amines will include m-toluidine. In an embodiment, the one or more aromatic amines will include p-toluidine. In an embodiment, the one or more aromatic amines will include both p-toluidine and m-toluidine. In an embodiment, two or more aromatic amines, may be present. In such case the two or more aromatic amines may be present, collectively, at not less than about thirty percent (30%) and not more than about forty percent (40%) by weight. In an embodiment, the aromatic amines may consist essentially of p-toluidine and m-toluidine.

TABLE 3

| Components of concentrate for additive or blend package | Ratios | Fractions of total additive package. This "additive", "blend", or "concentrate" package would then constitute from approximately 7.5% to 15% of total final gasoline. Sample calculations for 10% and 15% are shown, but the exact amount would be determined based on the desired final MON. | Blend Package as fraction of total gasoline | Blend Package as fraction of total gasoline | |
|---|---|---|---|---|---|
| | | | 0.100 components | 0.150 components | |
| Toluene | 0.05 | 0.455 | 0.0455 | 0.0682 | |
| pT | 0.035 | 0.318 | 0.0318 | 0.0477 | *** |
| mT | 0.005 | 0.045 | 0.0045 | 0.0068 | |
| ethanol | 0.02 | 0.182 | 0.0182 | 0.0273 | |
| Total | 0.11 | 1.000 | 0.1000 | 0.1500 | |

LOW SOLVENT CONCENTRATE: The package below would minimize the bulk volume, Then, additional alcohol would be added. In an embodiment, the concentrate would have only enough toluene to keep the pT In solution to a selected freeze point.

| | Ratios | | Fractions of total additive package. This "additive", or "blend", package would then constitute from - 4 to 10% of total final fuel. Sample calculations for 6.24% and 9.5% are shown, but the exact amount would be determined based on the desired final MON. | Blend Package as fraction of total fuel | Blend Package as fraction of total fuel | |
|---|---|---|---|---|---|---|
| | | | | 0.0624 | 0.095 | |
| Toluene | 0.03 | * | 0.429 | 0.2674 | 0.0407 | |
| pT | 0.035 | | 0.500 | 0.3120 | 0.0475 | *** |
| mT | 0.005 | | 0.071 | 0.0446 | 0.0068 | |
| ethanol | 0 | ** | 0.000 | 0.0000 | 0.0000 | |
| Total | 0.07 | | 1.000 | 0.6240 | 0.0950 | |

* more toluene may need to be added at refinery . . . depends on freeze point.

** ethanol would be added at refinery, blending stations, or depo (as it is not for car gas).

*** these values for pT and mT would be about the same using either additive/blend package. But the ocean freight or other freight would be lower, as the low solvent concentrate would only require about ⅔rds the shipped volume.

In an embodiment, the concentrate will further include one or more alcohols. In an embodiment, the one or more alcohols will include $C_1$ to $C_3$ alcohols. In an embodiment, the alcohols will include ethanol. In an embodiment, the alcohols will consist essentially of ethanol. In an embodiment, the one or more alcohols will include methanol. In an embodiment, the one or more alcohols will include both ethanol and methanol. In an embodiment, the one or more alcohols will consist essentially of ethanol and methanol. In an embodiment, the concentrate will include ethanol in an amount that is from about 1:4 to about 2:3, by weight, compared to the amount of the p-toluidine present. In an embodiment, the concentrate will include methanol, and the amount of methanol is from about 1:4 to about 2:3, by weight, compared to the amount of the p-toluidine present.

In various embodiments, the weight ratio of aromatic solvent as compared to aromatic amine may be about 1:1, or more. In an embodiment, toluene comprises an amount that is from about 1:1 to about 2:1, by weight, compared to the amount of p-toluidine present. In an embodiment, the amount of aromatic amine may be at least thirty percent (30%) by weight of said concentrate. In an embodiment, the amount of alcohols may be about twenty percent (20%) or less by weight of the concentrate. A suitable additive package composition is provided in TABLE 3.

By use of the concentrate additive package just described above, a method for manufacturing a high octane unleaded aviation gasoline has been developed. The method includes (a) providing a concentrate additive package as set forth above, and (b) providing an unleaded aviation gasoline base fuel, as for example set forth in connection with Tests 1 through 20 above. More generally, in an embodiment, such an unleaded aviation gasoline base fuel, ready for blending, may include:

(i) a high grade aviation alkylate having a selected motor octane number (MON) of at least 96;

(ii) one or more dialkylbenzenes, the one or more dialkylbenzenes including one or more of meta-xylene, para-xylene, and ortho-xylene, wherein the meta-xylene and the para-xylene together comprise no more than about forty five percent (45%) by weight of a finished high octane unleaded aviation gasoline, and the para-xylene comprising no more than thirteen percent (13%) by weight of a finished high octane unleaded aviation gasoline, and the ortho-xylene comprising no more than eleven percent (11%) by weight of the finished high octane unleaded aviation gasoline;

(iii) two or more monoalkylated benzenes, the two or more monoalkylated benzenes including ethylbenzene and toluene; and (iv) the combination of effective amounts of butane and isopentane wherein vapor pressure in said unleaded aviation gasoline is in the range between 38 kPa and 49 kPa, as measured using ASTM Standard D5191.

The method further includes mixing the concentrate additive package with the unleaded aviation gasoline base fuel just described above. said unleaded aviation gasoline base. In an embodiment, the method includes adding an effective amount of the concentrate wherein the freezing point of said high octane unleaded aviation gasoline is minus forty seven degrees Centigrade (−47° C.), or lower, as tested per ASTM standard D910 for Grade 100LL aviation gasoline. In an embodiment, the method includes adding an effective amount of the concentrate wherein the freezing point of said high octane unleaded aviation gasoline is minus fifty eight degrees Centigrade (−58° C.), or lower, as tested per ASTM standard D910 for Grade 100LL aviation gasoline.

Further, concentrate additive packages may be provided which (a) include the alcohols as noted above, or (b) which do not include the alcohols as noted above. In the latter case, the method further includes providing selected additional alcohols, and mixing the same with the concentrate package, prior to admixture with the unleaded aviation gasoline base fuel, or alternatively directly mixing the additional alcohols directly into the unleaded aviation gasoline base fuel, or alternatively, providing the unleaded aviation base fuel with the selected additional alcohols already included. In any event, such selected additional alcohols may include ethanol and/or methanol. In an embodiment, isopropyl alcohol may be included.

Those of skill in the art will know that various products from refining operations may vary widely depending on the manufacturer. For example, refinery run iso-octane may vary in composition from refinery to refinery. Similarly, refinery run high grade aviation alkylates may vary in composition from refinery to refinery. And, producers of xylenes may have various end compositions in their output products, and other compounds may be found in such products, depending on equipment used for the production, and on the specifications of their various customers. However, one useful commercial xylol mixture useful for the manufacture of unleaded aviation gasoline blends have been found to include about twenty percent (20%) by weight of 1,4-dimethylbenzene, about fourteen percent (14%) of 1,2-dimethylbenzene, about forty four percent (44%) of 1,3-dimethylbenzene, and about twenty two percent (22%) of ethylbenzene. The reader is referred to the ASTM specification for the composition of an acceptable xylol mixture. However, it must be appreciated that other ranges of such xylol mixture components may be used to prepare novel unleaded aviation gasoline blends as described herein. And, other aliphatic aromatic hydrocarbons may be useful, with usage adjustable according to performance and economic objectives sought for a particular final unleaded aviation gasoline blend.

By way of background, it must be noted that in most circumstances, FBO Grade 100LL avgas typically has a MON in excess of the minimum MON required by the applicable ASTM Standard D910. Companies selling avgas typically include a small "MON quality giveaway" to assure that the avgas, at the pump, exceeds the minimum ASTM specifications. Thus, the MON of a FBO Grade 100LL may actually be found, upon sampling and testing, to be in the range of from about 100 to about 105, but more often in the middle of such range. However, the MON of a FBO Grade 100LL may be seen with values of 100, or 100.5, or 101, or 101.5, or 102, or 102.5, or 103, or more. Thus, economics may guide the final blend ratios utilized by a manufacturer of the unleaded aviation gasoline blends described herein in producing an unleaded aviation gasoline blend having a desired final MON, and a desired final supercharge rating. In other words, more or less of a selected monoalkylated benzene, dialkylated benzene may be used in manufacture of an unleaded aviation gasoline blend, depending upon the actual amount and composition of alkylated benzenes utilized, and which aromatic amine(s) are selected, such as m-toluidine, how much of the selected aromatic amine(s) are used, in the final unleaded aviation gasoline blend.

Various unleaded aviation gasoline base fuels may be suitable to provide the novel unleaded aviation gasoline blends and the accompanying results described herein. For example, a high grade aviation alkylate may be a useful base fuel, or a commercial grade iso-octane may be a useful base fuel. A mixture of a high grade aviation alkylate enhanced by addition of a portion of a commercial grade iso-octane may be a useful base fuel. As an example, an unleaded gasoline base fuel including (by weight) about twenty percent (20%) to about ninety percent (90%) of iso-octane, about one percent (1%) to about twenty percent (20%) of $C_4$ to $C_5$ paraffins, and the balance being primarily light alkylates, would be suitable. In an embodiment, providing iso-octane at about eighty percent (80%) may be suitable. In an embodiment, a paraffin composition in the ten percent (10%) to twenty percent (20%) range by weight, in the unleaded aviation base fuel, is anticipated to be suitable. In an embodiment, iso-pentane may be used as the paraffin of choice. In such case, iso-pentane in the unleaded aviation gasoline base fuel of about fifteen percent (15%) may be suitable. In various embodiments, it may be desirable to add butane and or iso-butane, to achieve distillation curve or vapor pressure objectives, to produce an exemplary unleaded aviation gasoline gasoline. To the extent feasible, consistent with my objective of teaching how to manufacture an economical high octane unleaded aviation gasoline, it may in many cases be advantageous to use as much butane as feasible, compared to iso-pentane, consistent with compliance with applicable vapor pressure curve requirements.

Various unleaded aviation gasoline base fuels are available from various refineries, and in various embodiments of an unleaded aviation gasoline blend as taught herein, variations on the motor octane number (MON) of the aviation gasoline base fuels are anticipated to be workable. For example, in an embodiment, a 95 MON unleaded base fuel is known by my experiments to be workable, by blending an effective amount of 1,3-dimethylbenzene to the base fuel to provide an unleaded aviation gasoline blend meeting the performance objectives as set forth and claimed herein, which in an embodiment include detonation performance equivalent to, or better than, the full scale engine detonation performance of a Grade 100LL fuel that meets the minimum octane rating requirements set forth in ASTM Standard D910. And, in another embodiment, such objectives include detonation performance in a full scale engine equivalent to (FSEEMON), or better than, the full scale engine detonation performance of a selected FBO Grade 100LL fuel having a selected MON. In an embodiment, addition of minor amount of aliphatic aromatic hydrocarbons may be provided, and such mixtures would preferably include such compounds as may enhance the octane performance of the final unleaded aviation gasoline fuel blend. Similarly, it is anticipated that use of a 94 MON base fuel will provide advantageous results, when used with somewhat increased proportions of 1,3-dimethylbenzene, and/or slightly increased proportions of a selected additional alkyl benzene or other aliphatic aromatic hydrocarbon, especially some of the above mentioned compounds that provide octane enhancing properties.

In the various examples just mentioned, where not otherwise already specified, methylbenzene (toluene) may be utilized as one of the one or more additional alkylated benzenes. Also, in the various examples just mentioned, where not otherwise already specified, where necessary or required for assuring adequate Reid Vapor Pressure of a final unleaded aviation gasoline fuel blend to meet applicable specifications or service conditions, a suitable unleaded aviation gasoline blend may further include more than zero percent (0%) up to about five percent (5%) butane, by weight. In an embodiment, a selected butane, such as n-butane, may be added so that an unleaded aviation gasoline has a vapor pressure at 38° C., between a minimum of 38 kPa and a maximum of 49 kPa, per applicable ASTM test methods. Also, constituents such as iso-pentane or other paraffins may be provided. For example, as a supplement to amounts already in some unleaded aviation gasoline base fuels, amounts of more than zero percent (0%) up to about five percent (5%) of additional $C_5$-$C_6$ paraffins may be added. In an embodiment, because of its relatively low boiling point, iso-pentane may be selected for further addition to complete a workable, high performance, final unleaded aviation gasoline blend.

Availability of a novel unleaded aviation gasoline fuel blend having a functional performance as good or better than traditional aviation gasoline fuels with a motor octane number (MON) of 99.6, or more, which blend provides full scale aircraft piston engine detonation performance as good as, or better than, that currently available using Grade 100LL fuels which minimally meet the MON standards of ASTM Standard D910, will be of considerable interest to a large number of users of high performance aircraft piston engines. Moreover, availability of a novel unleaded aviation gasoline blend effective to increase the detonation performance of the unleaded aviation gasoline fuel blend to an equivalent (the FSEEMON of the unleaded aviation gasoline fuel blend), or better, when tested in a full scale aircraft engine, compared to the detonation performance of a selected FBO Grade 100LL avgas having a selected MON, will be of even more interest to users of high performance aircraft piston engines. This is especially notable, since although various alkylbenzenes have long been utilized in various fuels, in so far as I am aware, mixtures using relatively high amounts of suitable octane enhancing alkylbenzenes, such as those described herein, have not been evaluated on full scale aircraft engines sufficiently to appreciate the FSEEMON advantage evident, compared to FBO Grade 100LL fuels of selected MON. The perceived general knowledge in the industry that unleaded fuels would underperform on full scale aircraft engines leaded fuels of the same or similar ASTM D2700 MON during detonation testing, based on lab testing, also led to the failure of others to fully investigate the detonation performance of unleaded fuels at actual engine operating conditions at moderate and heavy detonation intensity levels as determined by the ASTM D6424 algorithm.

In an embodiment, the high octane unleaded aviation gasoline fuel blends just described, and their use in the method of functional drop-in-substitution in an existing engine may include blends as set forth in any various samples with suitable freezing point conditions as noted in the Test examples above, or within the ranges set forth in the claims as regards compositions stated, with respect to various percentages of components, or with respect to the more specific formulations. As mentioned above, where necessary or required for assuring adequate Reid Vapor Pressure of a final unleaded aviation gasoline blend to meet applicable specifications or service conditions, unleaded aviation gasoline fuel blends having more than zero percent (0%) up to about five percent (5%) butane, by weight may be utilized. Also, for the same purpose, in addition to any iso-pentane or other paraffins that may be present in the aviation base fuel, using amounts of more than zero percent (0%) up to about five percent (5%) additional $C_5$-$C_6$ paraffins can be useful in practice of the method.

In an embodiment, a suitable aviation unleaded base fuel may be provided by a mixture of (a) iso-octane (at about seventy percent (70%) or more by weight) and (b) iso-pentane (at about twenty percent (20%) or less by weight). In an embodiment, a suitable commercial grade iso-octane may be provided having a MON of at least 97, per the ASTM D910 test procedure. In an embodiment, a suitable commercial grade iso-octane may be provided having a MON of at least 98, per the ASTM D910 test procedure. In an embodiment, a suitable commercial grade iso-octane may be provided having a MON of at least 99, per the ASTM D910 test procedure. In an embodiment, a suitable iso-octane may be provided using commercial grade 2,2,4-tri-methyl pentane.

Various unleaded aviation base fuels are described explicitly herein, or are incorporated herein by reference, and one or more of such base fuels may be used in preparation of a useful unleaded aviation gasoline blend according to the teachings herein.

In summary, various novel unleaded aviation gasoline blends have been described, as well as methods for their formulation, preparation, and manufacture. Testing has revealed that it is possible to provide blends of unleaded aviation gasolines, by combining high quality unleaded base fuels, such as high quality aviation alkylate or commercial iso-octane, with one or more di-alkylated an monoalkylated benzenes, and with suitable quantities of aromatic amines such as p-toluidine and/or m-toluidine, and selected amounts of alcohols, in order to formulate an exemplary finished high octane unleaded aviation gasoline. In various embodiments, such as finished high octane unleaded aviation gasoline exhibits, in full scale high performance aviation piston engines, detonation performance at least equivalent to that of a selected FBG Grade 100LL avgas having a selected MON. Those alkylated benzenes which provide octane enhancing properties to the unleaded aviation gasoline and which may be particularly useful in providing economic unleaded aviation gasoline fuel blends are, in an embodiment, those wherein the amount of commercially available di-alkylated benzenes, and particularly xylol mixtures including 1,3-dimethylbenzene, may be maximized in a novel high octane unleaded aviation gasoline blend.

In the foregoing description, for purposes of explanation, numerous details have been set forth in order to provide a thorough understanding of the disclosed exemplary embodiments for the formulation of unleaded aviation gasoline blends. For descriptive purposes, various relative terms may be used. Terms that are relative only to a point of reference are not meant to be interpreted as absolute limitations, but are instead included in the foregoing description to facilitate understanding of the various aspects of the disclosed embodiments. And, various actions or activities in a method described herein may have been described as multiple discrete activities, in turn, in a manner that is most helpful in understanding the developments described herein. However, the order of description should not be construed as to imply that such activities are necessarily order dependent. In particular, certain mixing or blending operations may not necessarily need to be performed in the order of presentation. And, in different embodiments, one or more activities may be performed simultaneously, rather than sequentially. Also, the reader will note that the phrase "in an embodiment" or "in one embodiment" has been used repeatedly. This phrase generally does not refer to the same embodiment; however, it may. Finally, the terms "comprising", "having" and "including" should be considered synonymous, unless the context dictates otherwise.

Further, it should be understood by those of skill in the art and to whom this specification is directed that the term "aircraft" has been used herein consistent with US Federal Aviation Administration regulations to mean a device that is used or intended to be used for flight in the air. Under the same regulations and as used herein, the term "rotorcraft" means a heavier-than-air aircraft that depends principally for its support in flight on the lift generated by one or more rotors. Similarly, under the same regulations and as used herein, the term "helicopter" means a rotorcraft that, for its horizontal motion, depends principally on its engine-driven rotors. Finally, under the same regulations and as used herein, an "aircraft engine" means an engine that is used or is intended to be used for propelling aircraft. Appurtenances and accessories, and air compressors such as turbochargers, are normally considered by those of skill in the art, and under applicable FAA regulations, as components of the aircraft engines with respect to which they are operably connected. Thus, the unleaded aviation gasoline fuel blends described and claimed herein should be considered as useful for such piston driven "aircraft engines".

Importantly, the aspects and embodiments described and claimed herein may be modified from those shown without materially departing from the novel teachings and advantages provided by the developments disclosed herein, and may be embodied in other specific forms without departing from the spirit or essential characteristics thereof. Therefore, the embodiments presented herein are to be considered in all respects as illustrative and not restrictive or limiting. As such, this disclosure is intended to cover the formulations and blends described herein and the legal equivalents thereof. Numerous modifications and variations are possible in light of the above teachings. Therefore, the protection afforded should be limited only by the claims set forth herein, and the legal equivalents thereof.

The invention claimed is:

1. A high octane unleaded aviation gasoline composition, comprising:

(1) at least one unleaded aviation gasoline base fuel comprising an alkylate having a selected motor octane number of about 96 or more, the base fuel further comprising two or more dialkylbenzenes, the two or more dialkylbenzenes comprising at least two dialkylbenzenes selected from meta-xylene, and para-xylene, and ortho-xylene, wherein the meta-xylene and the para-xylene together comprise no more than about forty five percent (45%) by weight of the high octane unleaded aviation gasoline; and (2) a concentrate, wherein the high octane unleaded aviation gasoline consists of from about seven point five percent (7.5%) to about fifteen percent (15%) by weight of concentrate, and wherein the concentrate comprises (a) one or more aromatic solvents, the one or more aromatic solvents comprising at least about forty percent (40%) by weight of the concentrate, but not more than about fifty five percent (55%) by weight of the concentrate, wherein the one or more aromatic solvents comprises toluene;

(b) two or more aromatic amines, the two or more aromatic amines present in the concentrate, collectively, at not less than about thirty percent (30%) by weight, and wherein the two or more aromatic amines comprise para-toluidine and meta-toluidine;

(c) one or more $C_1$ to $C_3$ alcohols, the one or more $C_1$ to $C_3$ alcohols present in the concentrate, collectively, at about twenty percent (20%) or less by weight, wherein the one or more $C_1$ to $C_3$ alcohols comprises any one or more of methanol, ethanol, or isopropyl alcohol; and (d) wherein octane enhancement provided by the concentrate, in combination with the base fuel is sufficient to provide detonation performance of the high octane unleaded aviation gasoline in an aircraft engine that is equivalent, or better, than detonation performance of Grade 100 LL avgas which meets minimum octane requirements set forth in ASTM Standard D910.

2. A composition as set forth in claim 1, wherein the toluene is present in the concentrate at a level of not more than about fifty percent (50%) by weight.

3. A composition as set forth in claim 1, wherein the two or more aromatic amines are present in the concentrate, collectively, at not more than about forty percent (40%) by weight, and wherein para-toluidine is present at about thirty percent (30%) by weight or more in the concentrate.

4. A composition as set forth in claim 1, wherein the one or more $C_1$ to $C_3$ alcohols consists essentially of ethanol.

5. A composition as set forth in claim 1, wherein the one or more $C_1$ to $C_3$ alcohols consists essentially of isopropyl alcohol.

6. A composition as set forth in claim 1, wherein a ratio by weight of the one or more aromatic solvents to the one or more aromatic amines is from about 1:1, or more, by weight.

7. A composition as set forth in claim 1, wherein an amount of toluene present is from about 1:1 to about 2:1, by weight, compared to an amount of para-toluidine present in the concentrate.

8. A composition as set forth in claim 1, wherein the concentrate comprises a composition which, when mixed with said at least one unleaded aviation gasoline base fuel, provides a high octane unleaded aviation gasoline having a freezing point of minus fifty-eight degrees centigrade (−58° C.), or less.

9. A composition as set forth in claim 1, wherein the base fuel comprises isooctane.

10. A high octane unleaded aviation gasoline composition, comprising:

(1) at least one unleaded aviation gasoline base fuel comprising an alkylate having a selected motor octane number of at least 96, wherein the base fuel further comprises one or more of meta-xylene, para-xylene, and ortho-xylene, wherein the meta-xylene and the para-xylene together comprise no more than about forty five percent (45%) by weight of the manufactured high octane unleaded aviation gasoline;

(2) a concentrate, wherein the concentrate comprises from about ten percent (10%) to about fifteen percent (15%) by weight of the manufactured high octane unleaded aviation gasoline, and wherein the concentrate comprises:

(a) one or more aromatic solvents, the amount of the one or more aromatic solvents provided in the concentrate are present in the high octane unleaded aviation gasoline in an amount between about four point five five percent (4.55%) by weight and about six point eight two percent (6.82%) by weight;

(b) two or more aromatic amines, the two or more aromatic amines present in an amount in the concentrate, to comprise collectively, between about three point six three percent (3.63%) by weight and about five point four five percent (5.45%) by weight of the high octane unleaded aviation gasoline; and (c) wherein octane enhancement provided by the concentrate, in combination with the base fuel is sufficient to provide detonation performance of the high octane unleaded aviation gasoline in an aircraft engine that is equivalent, or better, than detonation performance of Grade 100 LL avgas which meets minimum octane requirements set forth in ASTM Standard D910-07.

11. A composition as set forth in claim 10, further comprising one or more $C_1$ to $C_3$ alcohols, the one or more $C_1$ to $C_3$ alcohols present in an amount in the concentrate to comprise, collectively, between about one point eight two percent (1.82%) by weight and about two point seven three percent (2.73%) by weight of the high octane unleaded aviation gasoline.

12. The composition as set forth in claim 11, wherein the one or more $C_1$ to $C_3$ alcohols comprises isopropyl alcohol, and wherein the two or more aromatic amines comprise para-toluidine and meta-toluidine.

13. The composition as set forth in claim 10, wherein the one or more aromatic solvents comprises one or more monoalkylated benzenes.

14. The composition as set forth in claim 10, wherein the one or more monoalkylated benzenes comprises toluene.

15. The composition as set forth in claim 14, wherein an amount of toluene present is from about 1:1 to about 2:1, by weight, compared to an amount of para-toluidine present in the concentrate.

16. The composition as set forth in claim 10, wherein one of the two or more aromatic amines comprises para-toluidine.

17. The composition as set forth in claim 10, wherein one of the two or more aromatic amines comprises meta-toluidine.

18. The composition as set forth in claim 10, wherein the two or more aromatic amines comprise para-toluidine and meta-toluidine.

19. The composition as set forth in claim 10, wherein the weight ratio of the one or more aromatic solvents to the one or more aromatic amines is from about 1:1, or more, by weight.

20. The composition as set forth in claim 10, wherein the concentrate comprises a composition which, when mixed with the at least one unleaded aviation gasoline base fuel, provides a high octane unleaded aviation gasoline having a freezing point of minue fifty-eight degrees centigrade (−58° C.), or less.

21. A composition as set forth in claim 10, wherein the base fuel comprises isooctane.

22. A high octane unleaded aviation gasoline composition, comprising:

(1) at least one unleaded aviation gasoline base fuel comprising an alkylate having a selected motor octane number of at least 96, wherein the base fuel further comprises one or more of meta-xylene, para-xylene, and ortho-xylene, wherein the meta-xylene and the para-xylene together comprise no more than about forty five percent (45%) by weight of the manufactured high octane unleaded aviation gasoline; and (2) a concentrate, wherein the concentrate comprises from about four percent (4%) to about ten percent (10%) by weight of the high octane unleaded aviation gasoline, and wherein the concentrate comprises (a) one or more aromatic solvents, the amount of the one or more aromatic solvents provided in the concentrate are present in the high octane unleaded aviation gasoline in an amount between about one point seven one percent (1.71%) and about four point two eight percent (4.28%) by weight;

(b) two or more aromatic amines, the two or more aromatic amines present in an amount in the concentrate, to comprise collectively, between about two point two eight percent (2.28%) by weight and about five point seven two percent (5.72%) by weight of the high octane unleaded aviation gasoline; and (c) wherein octane enhancement provided by the concentrate, in combination with the base fuel is sufficient to provide detonation performance of the high octane unleaded aviation gasoline in an aircraft engine that is equivalent, or better, than detonation performance of Grade 100 LL avgas which meets the minimum octane requirements set forth in ASTM Standard D910.

23. The composition as set forth in claim 22, wherein the one or more aromatic solvents comprises one or more monoalkylated benzenes.

24. The composition as set forth in claim 22, wherein the one or more monoalkylated benzenes comprises toluene.

25. The composition as set forth in claim 24, wherein an amount of toluene present is from about 1:1 to about 2:1, by weight, compared to an amount of para-toluidine present in the concentrate.

26. The composition as set forth in claim 22, wherein one of the two or more aromatic amines comprises para-toluidine.

27. The composition as set forth in claim 22, wherein one of the two or more aromatic amines comprises meta-toluidine.

28. The composition as set forth in claim 22, wherein the two or more aromatic amines comprise para-toluidine and meta-toluidine.

29. The composition as set forth in claim 22, wherein the weight ratio of the one or more aromatic solvents to the one or more aromatic amines is from about 1:1, or more, by weight.

30. The composition as set forth in claim 22, wherein the concentrate comprises a composition which, when mixed with the at least one unleaded aviation gasoline base fuel, provides a high octane unleaded aviation gasoline having a freezing point of minus fifty-eight degrees centigrade (−58° C.), or less.

31. A composition as set forth in claim 22, wherein the base fuel comprises isooctane.

* * * * *